US007207848B2

(12) United States Patent
Fukatsu et al.

(10) Patent No.: US 7,207,848 B2
(45) Date of Patent: Apr. 24, 2007

(54) CONNECTOR ASSEMBLY WITH SLIDER ASSISTED MATING AND TERMINAL LOCK

(75) Inventors: Yukihiro Fukatsu, Yokkaichi (JP); Masaya Horiuchi, Yokkaichi (JP); Toshikazu Sakurai, Yokkaichi (JP); Masayasu Fujii, Yokkaichi (JP); Youjirou Hashimoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/480,229

(22) Filed: Jun. 30, 2006

(65) Prior Publication Data

US 2007/0004288 A1 Jan. 4, 2007

(30) Foreign Application Priority Data

Jun. 30, 2005 (JP) ..... 2005-192127
Feb. 28, 2006 (JP) ..... 2006-052593

(51) Int. Cl.
*H01R 13/514* (2006.01)

(52) U.S. Cl. ..... 439/752; 439/299; 439/157

(58) Field of Classification Search ..... 439/752, 439/595, 701, 299, 307, 310, 157, 347
See application file for complete search history.

(56) References Cited

U.S. PATENT DOCUMENTS 5,569,054 A * 10/1996 Yagi et al. ..... 439/752
5,681,184 A 10/1997 Pamart et al.
5,775,957 A * 7/1998 Fink et al. ..... 439/752
5,823,807 A * 10/1998 Yamasaki et al. ..... 439/157
6,056,570 A 5/2000 Maejima
6,149,473 A 11/2000 Lalange et al.
6,527,583 B2 * 3/2003 Plate ..... 439/489
2005/0136714 A1 6/2005 Morikawa et al.

* cited by examiner

*Primary Examiner*—Tho D. Ta
*Assistant Examiner*—Vanessa Girardi
(74) *Attorney, Agent, or Firm*—Gerald E. Hespos; Anthony J. Casella

(57) ABSTRACT

A connector assembly has first and second housings (150, 10). Terminal fittings (112) are inserted into cavities (11) of the second housing (10) and are locked partially by locks formed in the second housing (10). A slider (30) is mounted in second housing (10) and engages a cam (43) in the first housing (150) to generate a cam action that helps to connect the housings (10, 150). The slider (30) has at least one retaining portion (136) that secondarily locks properly inserted terminal fittings (112) in the second housing (10). An inability to move the slider (30) provides an indication that at least one terminal fitting (112) is not inserted properly.

9 Claims, 31 Drawing Sheets

CONNECTOR ASSEMBLY WITH SLIDER ASSISTED MATING AND TERMINAL LOCK

BACKGROUND OF THE INVENTION

1. Field of the Invention

The invention relates to a connector, to a connector assembly and to assembling methods therefor.

2. Description of the Related Art

U.S. Pat. No. 5,569,054 discloses a connector with means for correcting the position of a terminal fitting that has been inserted insufficiently into a housing. More particularly, a correcting member is inserted into the housing at a right angle to an inserting direction of the terminal fitting. The correcting member has a slanted surface that contacts the insufficiently inserted terminal fitting and moves the terminal fitting to a proper position.

Some connectors have a first housing fixed to a vehicle body or the like and a second housing that is pushed into the first housing for connection. The second housing of the above-described connector may be difficult to push depending on the orientation of the first housing.

Some such connectors have a slider mounted on one housing for movement perpendicular to a connecting direction. The slider has a cam groove that engages a cam on the other housing. Movement of the slider creates a cam effect to facilitate connection of the two housings.

An attempt could be made to apply the means for correcting the positions of the terminal fittings to the above-described connector. However, a correcting member needs to be provided in addition to the slider, thereby presenting a problem of increasing the number of parts.

U.S. Patent Application Publication No. 2005/0136714 discloses a connector with a female housing, a male housing and a slider to connect and separate the housings. The slider is inserted and withdrawn in directions intersecting with a connecting direction of the two housings. Cavities are formed in a housing main body of the female housing for receiving female terminal fittings. A retainer for retaining the female terminal fittings in the cavities is mounted on the outer peripheral surface of the housing main body.

However, in the construction as above, the retainer must be provided in addition to the slider to retain the female terminal fittings, thereby presenting a problem of increasing the number of parts.

The present invention was developed in view of the above problem and an object thereof is to provide a suitable operability while avoiding an increase in the number of parts.

SUMMARY OF THE INVENTION

The invention relates to a connector with a housing that has terminal fittings mounted therein. The housing is connectable with a mating housing of a mating connector along a connecting direction. A movable member is assembled with the housing and is movable at an angle to the connecting direction. The movable member has at least one cam that engages a cam on the mating housing. The cams cooperate to connect the housing with the mating housing as the movable member is moved. The movable member may have at least one slanted surface for moving an insufficiently inserted terminal fitting to a proper insertion position by engaging the insufficiently inserted terminal fitting as the movable member is assembled with the housing and/or operated to connect the housing with the mating housing.

The connector has fewer parts than a connector with a separate terminal position correcting member in addition to the movable member.

The housing preferably is connectable with the mating housing substantially parallel with an inserting direction of the terminal fittings into the housing.

The movable member preferably is a slider in the form of a single plate. Thus, an accommodation space for the slider in the housing is small, and the entire connector can be smaller.

The terminal fittings preferably are arranged at least at first and second stages in the housing, and the movable member is accommodated between the first and second stages of terminal fittings. As a result, connection resistance from friction between the terminal fittings is balanced with respect to the slider. Therefore, a forcible connection of the housings in an inclined posture is less likely.

The invention also relates to a connector assembly comprising the above described connector and a mating connector.

The housing of the connector preferably has cavities for receiving the terminal fittings. Each has a lock for primarily locking the respective terminal fitting. The movable member includes at least one retainer for secondarily locking the terminal fittings inserted into the cavities to retain the terminal fittings as the movable member is assembled into the second housing or as the movable member is operated. The movable member functions to connect the two housings and to lock the terminal fittings in the cavities. Thus, it is not necessary to provide a separate retainer in addition to the movable member. Accordingly, the connector has fewer parts and can be assembled more easily.

The movable member preferably is a slider with a cam groove that engages a cam pin on the mating housing. The two housings are connected by a cam action of the engagement of the cam pin and the cam groove upon assembling the slider. The slider preferably includes a retainer for fully locking the terminal fittings inserted into the cavities to retain the terminal fittings as the slider is assembled into the second housing. Accordingly, it is not necessary to provide a separate retainer in addition to the slider.

The housing preferably has a slider accommodating portion for receiving the slider. The slider accommodating portion extends in a direction intersecting the cavities. A communicating portion is formed along an inserting direction of the slider between the slider accommodating portion and the cavities so that the slider accommodating portion and the cavities communicate with each other. A retaining portion of the slider preferably passes along the communicating portion as the slider is inserted into the slider accommodating portion, and is located on insertion and withdrawal paths for the terminal fittings in the respective cavities to secondarily lock the terminal fittings secondarily when the slider is inserted completely.

An insufficient insertion detecting surface may be formed on the slider for contacting an insufficiently inserted terminal fitting and preventing movement of the slider. Thus, the insufficiently inserted state of the terminal fittings can be known.

Plural cavities preferably are juxtaposed along the inserting direction of the slider. The retaining portion of the slider preferably has an elongated shape that extends substantially continuously over the juxtaposed cavities. The continuously extending retaining portion is stronger than an interrupted retaining portion.

The slider preferably has a substantially plate-shaped main body that is inserted into the slider accommodating portion. The cavities are arranged at an upper side and a lower side of the main body with respect to the thickness direction of the main body. The slider is between the cavities at the upper side and those at the lower side and retaining portions are provided on each of the upper and lower surfaces of the main body. Accordingly, the main body is used commonly for the cavities at the upper and lower sides.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
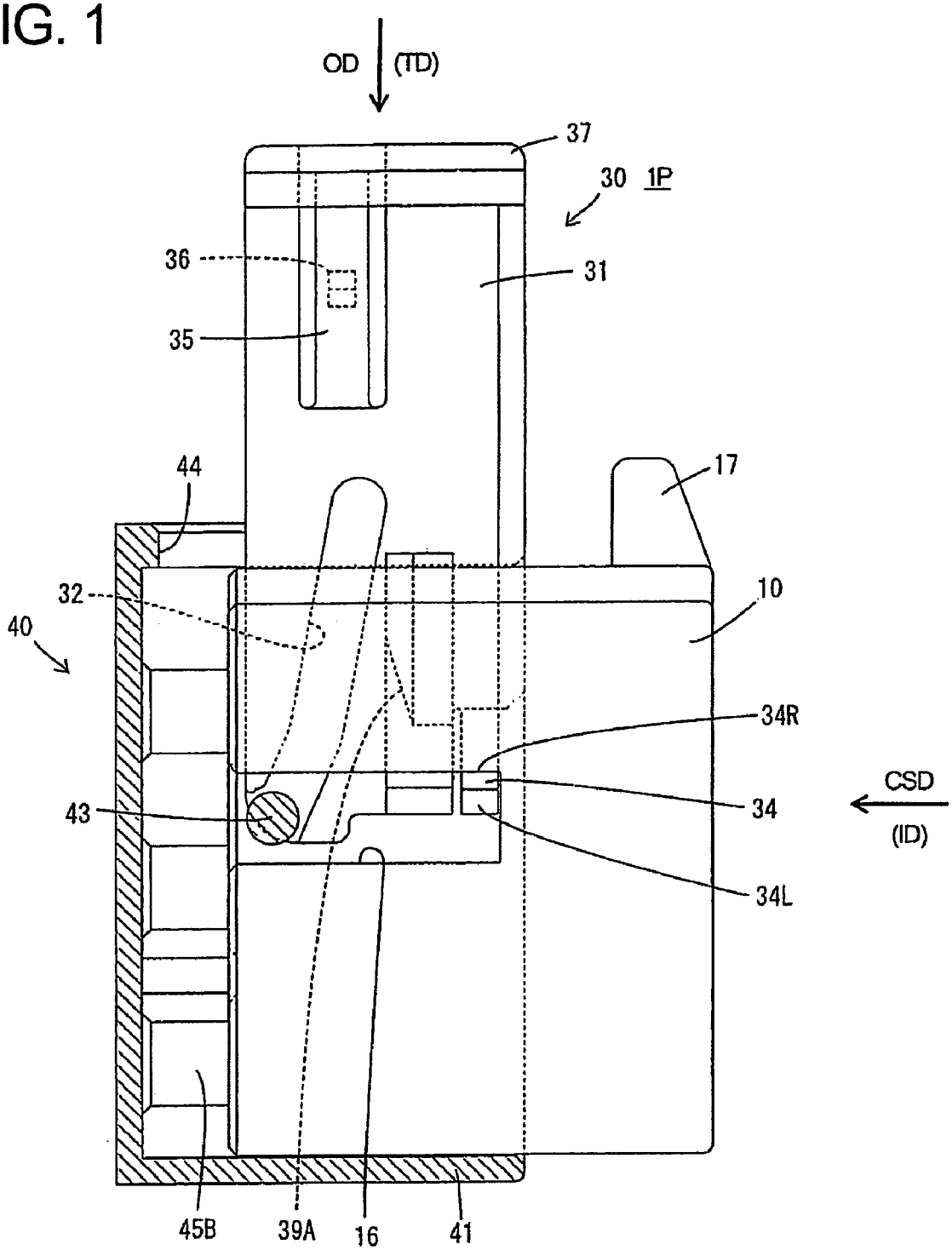
FIG. 1 is a plan view showing a slider at a partial locking position in one embodiment of the invention.

A first embodiment of the invention is described with reference to FIGS. 1 to 14. A connector of this embodiment has a first housing 10 and a second housing 40 that are connectable with and separable from each other. A slider 30 is assembled with the first housing 10 and can be operated along an operation direction OD for connecting the two housings 10, 40. The operation direction OD is substantially perpendicular to connecting and separating directions CSD of the two housings 10, 40.

The first housing 10 is substantially in the form of a rectangular block, and plurality of cavities 11A, 11B are formed at upper and lower stages therein. Specifically, two cavities 11A are formed at the upper stage, whereas three cavities 11B are formed substantially side by side at the lower stage. A resiliently deformable lock 12A is cantilevered along a direction intersecting a longitudinal direction of the cavities and extends substantially forward along the upper wall of each cavity 11A at the upper stage. Similarly, a resiliently deformable lock 12B is cantilevered along a direction intersecting a longitudinal direction of the cavities and extends substantially forward along the bottom wall of each cavity 11B at the other lower stage.

A substantially flat accommodation space 14 is formed in a partition wall 13 that partitions the cavities at the upper and lower cavities 11A, 11B and opens in the right outer surface of the first housing 10. The partition wall 13 also has communication holes 15A that communicate with the accommodation space 14 and the upper cavities 11A and communication holes 15B that communicate with the accommodation space 14 and the lower cavities 11B. A part of the first housing 10 between the left and right cavities 11A at the upper stage is cut away to form an escaping recess 16 that openings in the front and upper surfaces of the first housing 10. The escaping recess 16 communicates with the accommodation space 14. Further, upper and lower protections 17 are formed near the rear end of the right outer surface of the first housing 10.

Figure 5:
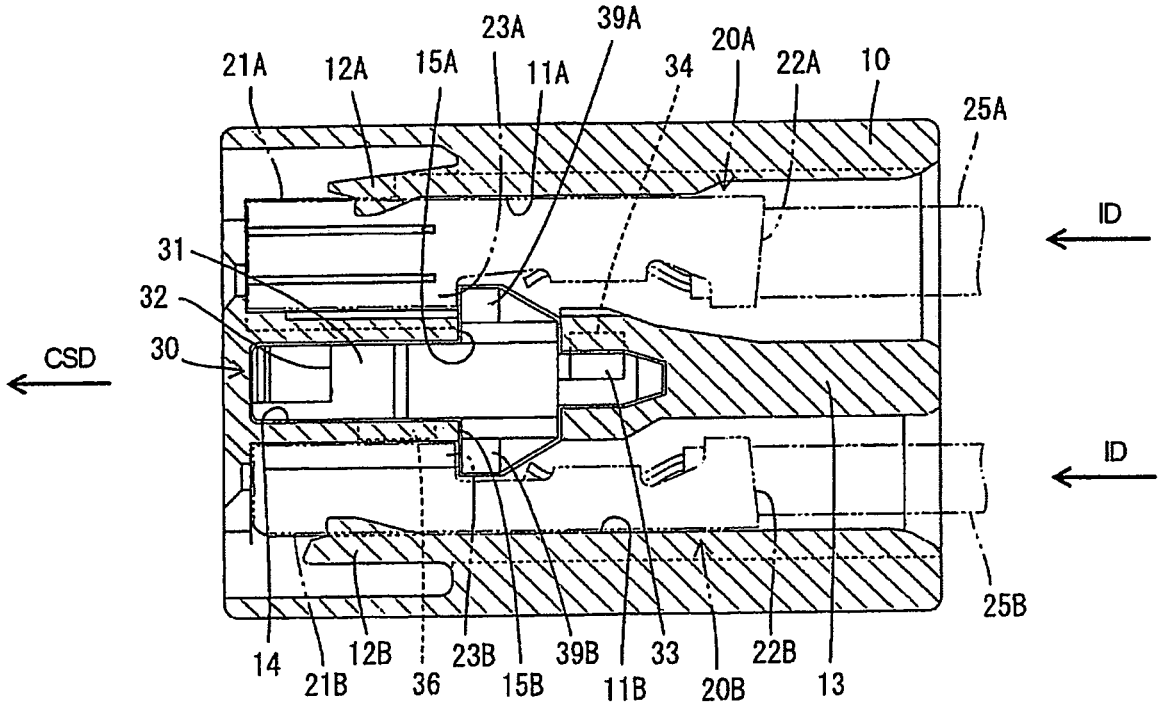
FIG. 5 is a section of a first housing.
Figure 6:
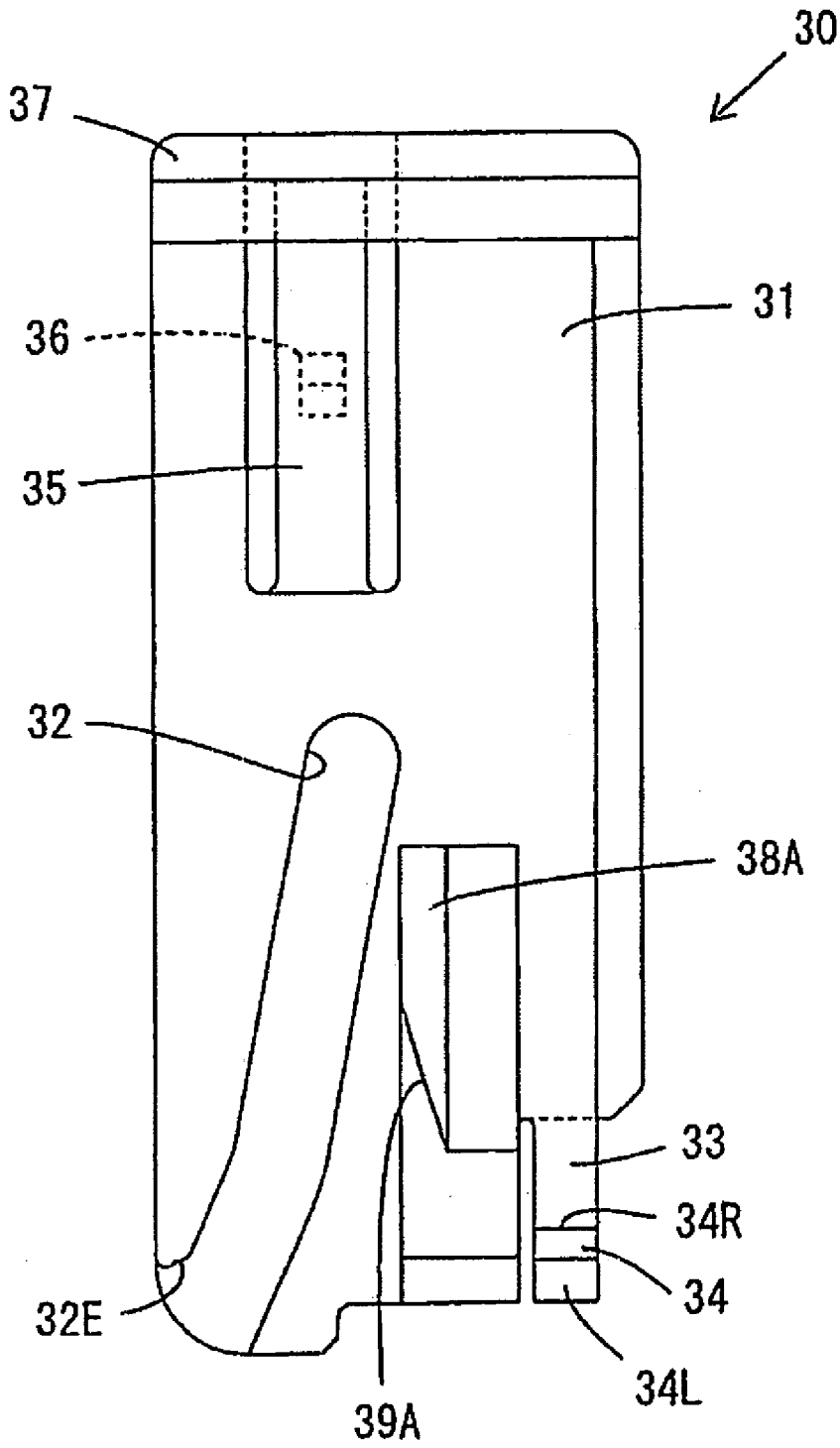
FIG. 6 is a plan view of the slider.

As shown in FIG. 5, first terminal fittings 20A, 20B are inserted into the respective cavities 11A, 11B from behind and along a direction ID substantially parallel to the connecting and separating directions CSD of the two housings 10, 40. Each first terminal fitting 20A, 20B is long and narrow in forward and backward directions. A rectangular tubular terminal connecting portion 21A, 21B is formed at the front of each first terminal fitting 20A, 20B and a wire connecting portion 22A, 22B at the rear. The front end of a wire 25A, 25B is connected electrically with each wire connecting portion 22A, 22B by crimping, bending, folding, insulation displacement, soldering or the like. A cut is made in the upper wall of the terminal connecting portion 21A of each first terminal fitting 20A inserted into the upper cavity 11A to form a locking hole (not shown), and the bottom edge of the rear end of the terminal connecting portion 21A serves as an engaging portion 23A. Similarly a cut is made in the bottom wall of the terminal connecting portion 21A of each first terminal fitting 20A inserted into the lower cavity 11A to form a locking hole (not shown), and the upper edge of the rear end of the terminal connecting portion 21A serves as an engaging portion 23A. The first terminal fittings 20A, 20B are inserted to proper positions PIP where further forward movement is stopped by front walls 10F of the cavities 11A, 11B, and where the locks 12A, 12B engage the locking holes. Thus, the first terminal fittings 20A, 20B are retained in the first housing 10 and the engaging portions 23A, 23B at the rear ends of the terminal connecting portions 21A, 21B face the front edges of the communicating holes 15A, 15B. With the first terminal fittings 20A, 20B insufficiently inserted and at positions offset behind the proper insertion positions PIP, the locking holes do not engage with the locks 12A, 12B and the engaging portions 23A, 23B at the rear ends of the terminal accommodating portions 21A, 21B facing the communicating holes 15A, 15B.

The slider 30 is made e.g. of a synthetic resin and is substantially in the form of a single plate that is in a transverse direction TD, which is substantially parallel to the operating direction OD. The slider 30 has a substantially rectangular plate-shaped main portion 31, and a cam groove 32 is formed in an upper side of the main portion 31. The cam groove 32 is oblique both to connecting and separating directions CSD and to transverse direction TD. An entrance 32E to the cam groove 32 is located near the left end of the front edge of the main portion 31. A partial locking piece 33 is cantilevered from the left end of the main portion 31 and extends to the left near the rear edge of the main portion 31. The partial locking piece 33 is resiliently deformable in directions substantially normal to the transverse direction CD and the operating direction OD. A partial locking projection 34 is formed at the extending left end of the upper surface of the partial locking piece 33. The left surface of the partial locking projection 34 comprises a guiding slanted surface 34L sloped down to the left. The opposite right surface of the partial locking projection 34 is a locking surface 34R that extends substantially at a right angle to the horizontal assembling direction of the slider 30 into the first housing 10. A resiliently deformable full locking piece 35 extends laterally to the right in a right-half area of the main portion 31 and is resiliently deformable vertically and substantially normal to the transverse direction CD. A full locking projection 36 is formed on the lower surface of the full locking resilient piece 35 and has left and right surfaces inclined to an operating direction OD of the slider 30, which is horizontal in the figures. The slider 30 also has two knobs 37 in the form of ribs that project up and down along the right surface of the main portion 31.

An upper stage protrusion 38A is formed between the cam groove 32 and the partial locking resilient piece 33 at the left end of the upper surface of the main portion 31. The upper stage protrusion 38A is narrow and long in the transverse direction TD. An upper-stage slanted surface 39A is formed at the corresponding left end of the front surface of the upper-stage protrusion 38A and is oblique to transverse direction TD. On the other hand, a lower-stage protrusion 38B is formed between the cam groove 32 and the partial locking resilient piece 33 at the opposite left end of the lower surface of the main portion 31. The lower-stage protrusion 38B is substantially narrow and long in the transverse direction TD. A lower-stage slanted surface 39B is formed at the left end of the front surface of the lower-stage protrusion 38B and is oblique to transverse direction TD.

Figure 13:
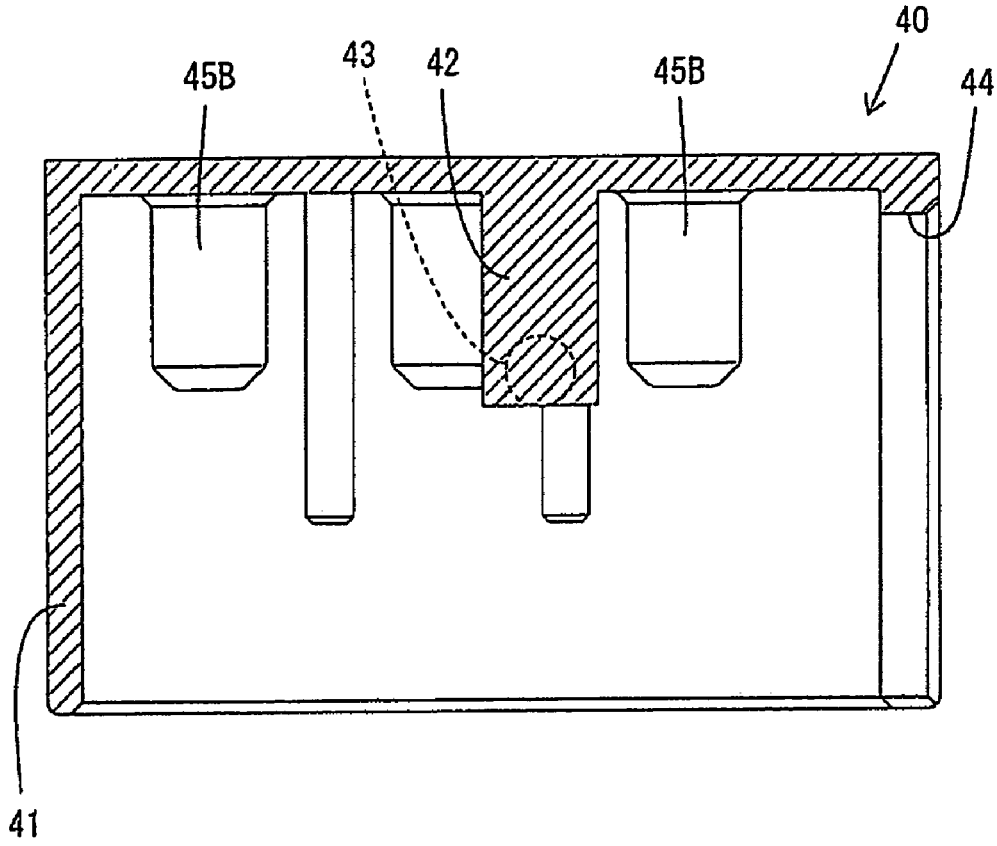
FIG. 13 is a section along X—X of FIG. 12.
Figure 14:
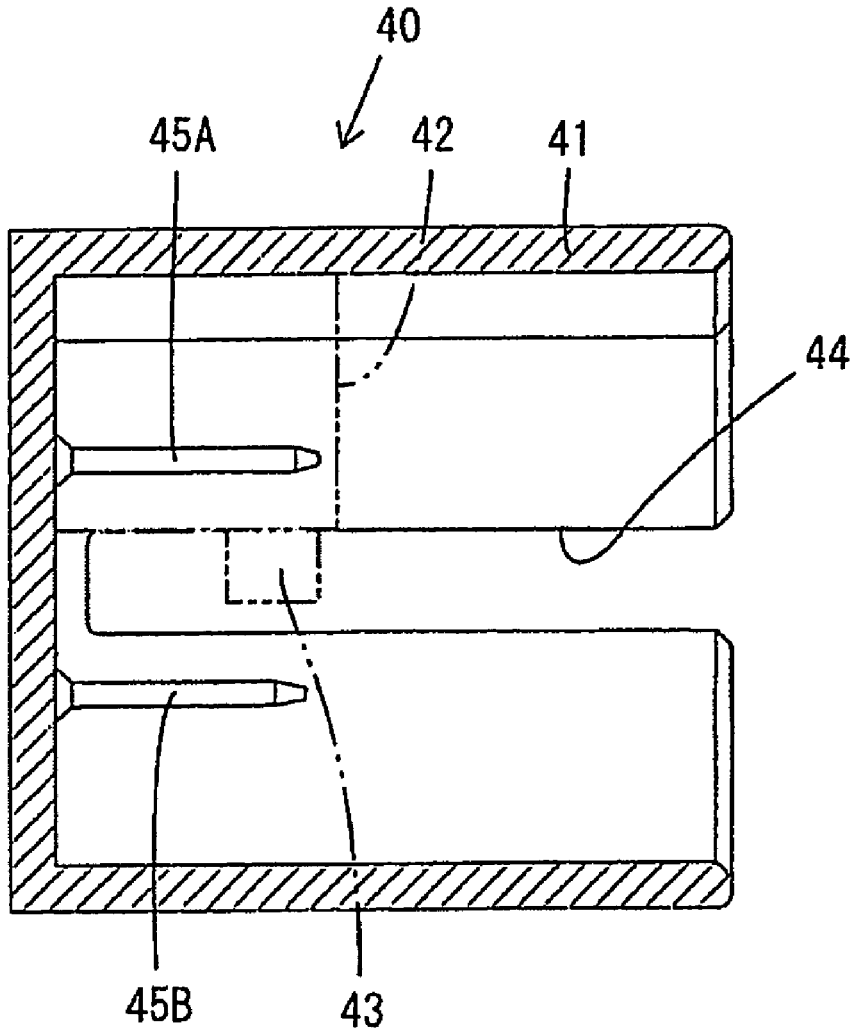
FIG. 14 is a section along Y—Y of FIG. 12.

As shown in FIGS. 13 and 14, the second housing 40 is to be fixed to a device e.g. of an automotive vehicle. A rectangular tubular receptacle 41 projects forward on the second housing 40 and long narrow second terminal fittings 45A, 45B project forward in the receptacle 41. The second terminal fittings 45A, 45B are arranged at upper and lower stages corresponding to the first terminal fittings 20A, 20B. A support 42 projects down from the upper wall of the receptacle 41 and is substantially normal to the connecting and separating directions CSD. A substantially cylindrical cam follower 43 projects down from the lower surface of the support 42 and has a longitudinal axis that is substantially perpendicular to the connecting direction CSD of the two housings 10, 40. A notch 44 extends substantially straight back from the front edge of the left wall of the receptacle 41 for avoiding the interference with the slider 30 during connection of the two housings 10, 40

The first terminal fittings 20A, 20B are inserted into the cavities 11A, 11B of the first housing 10 from behind and along an inserting direction ID before the slider 30 is assembled into the first housing 10. The first terminal fittings 20A, 20B are held at the proper positions PIP by the engagement of the locks 12A and 12B in the locking holes. The engaging portions 23A, 23B at the rear ends of the connecting portions 21A, 21B of the insufficiently inserted first terminal fittings 20A, 20B face the communication holes 15A, 15B.

Figure 7:
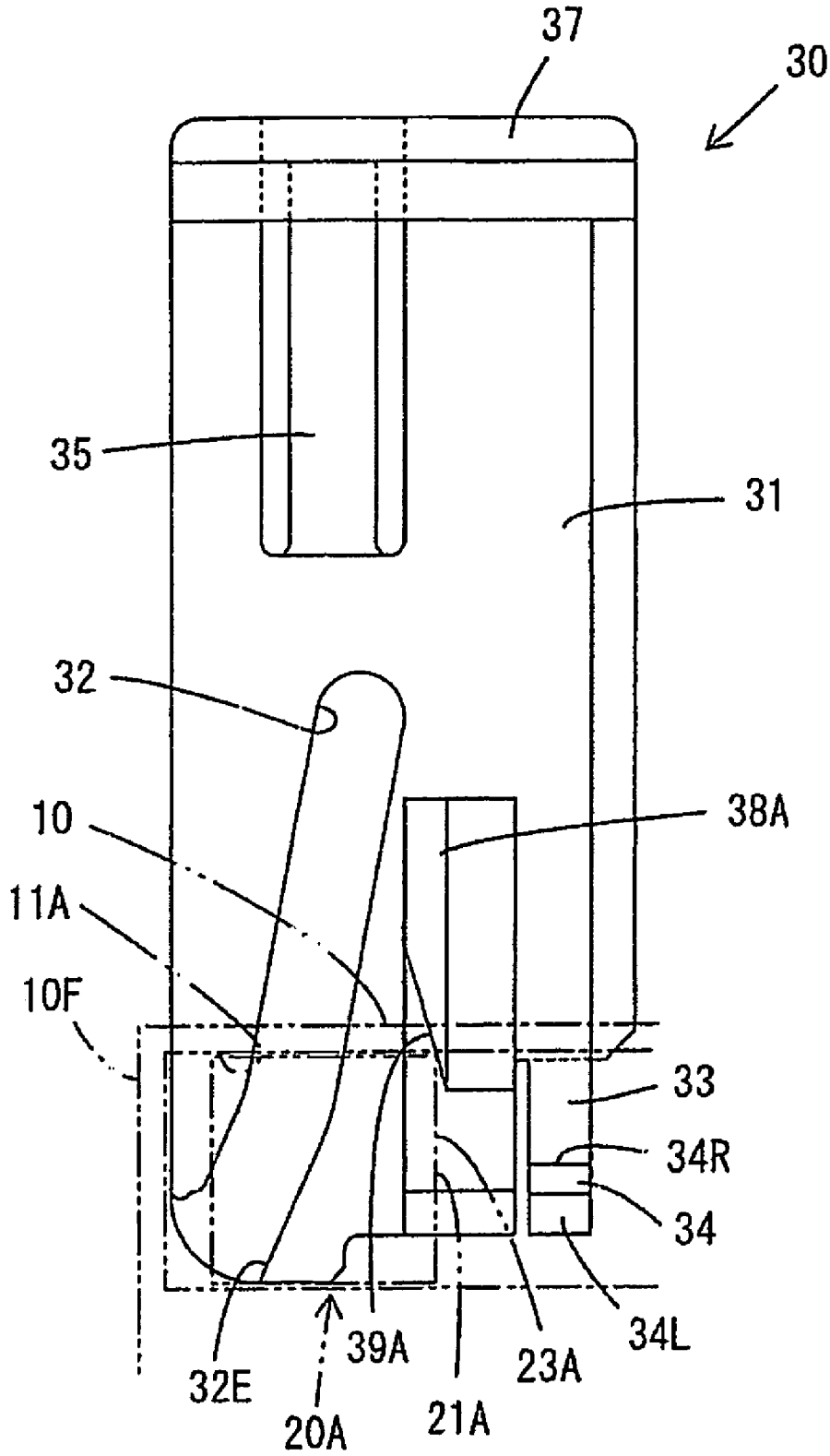
FIG. 7 is a plan view showing a slanted surface in contact with an insufficiently inserted first terminal fitting.
Figure 8:
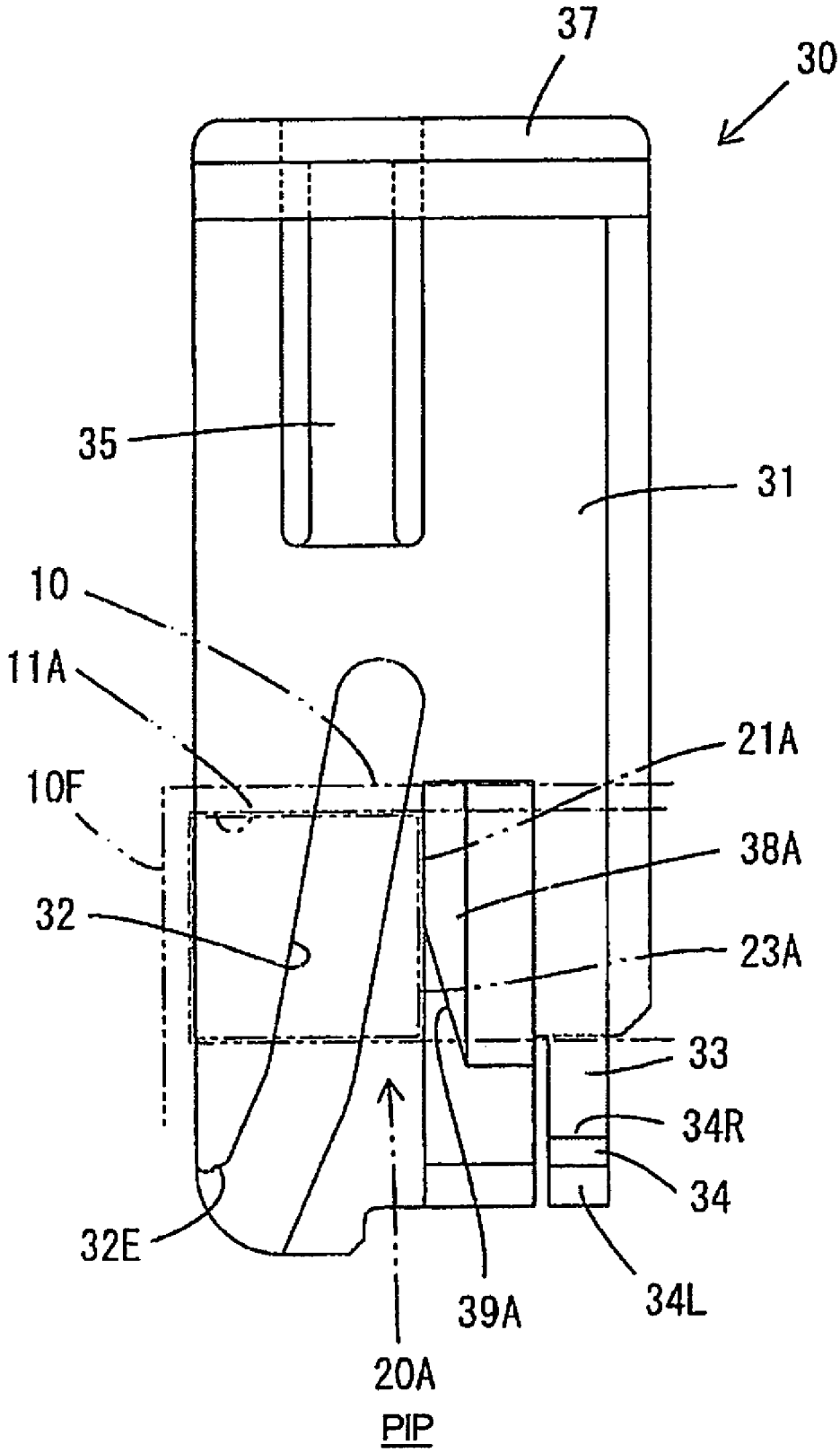
FIG. 8 is a plan view showing a state reached by moving the insufficiently inserted first terminal fitting to a proper insertion position by the slanted surface.
Figure 9:
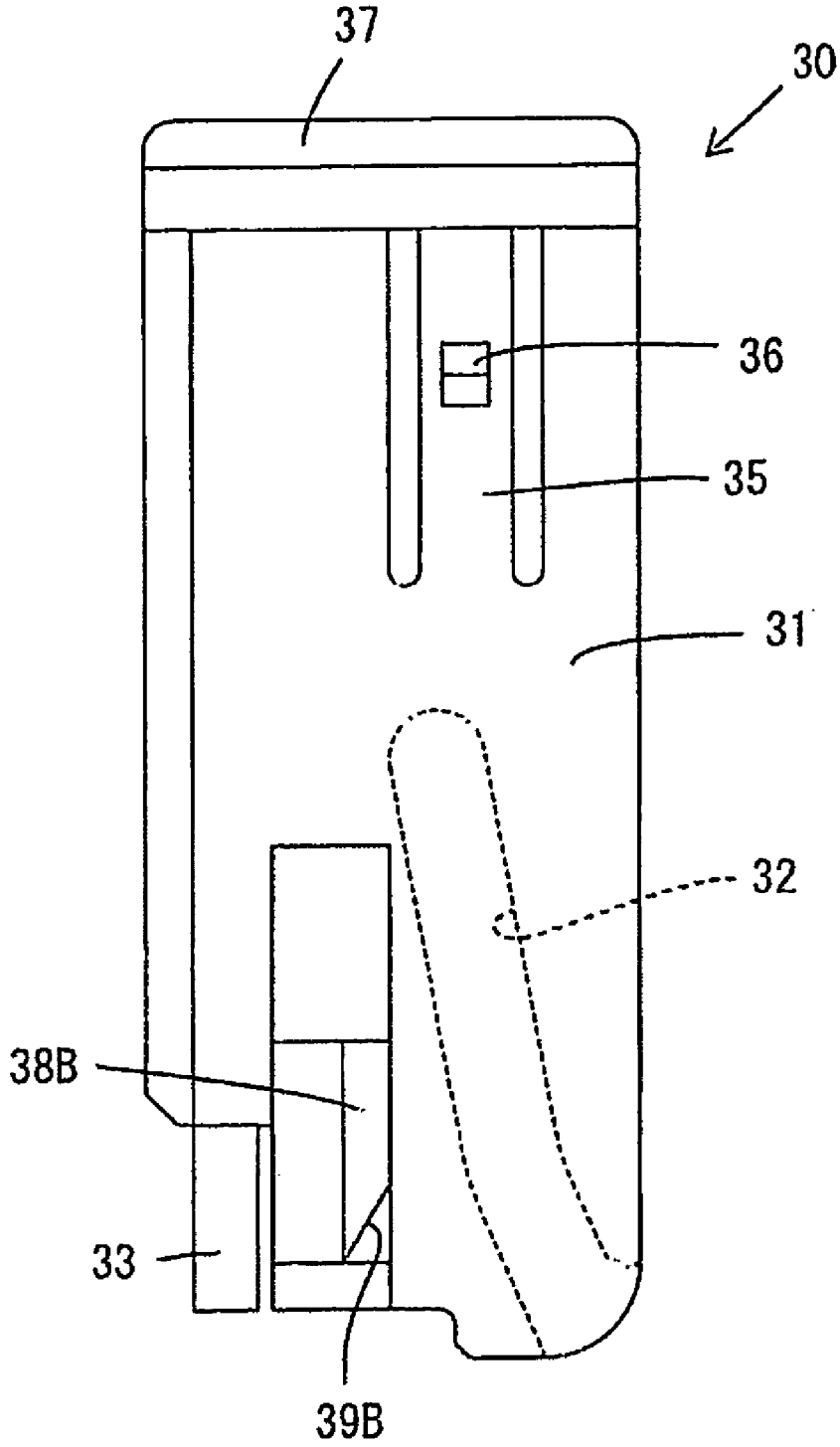
FIG. 9 is a bottom view of the slider.
Figure 10:
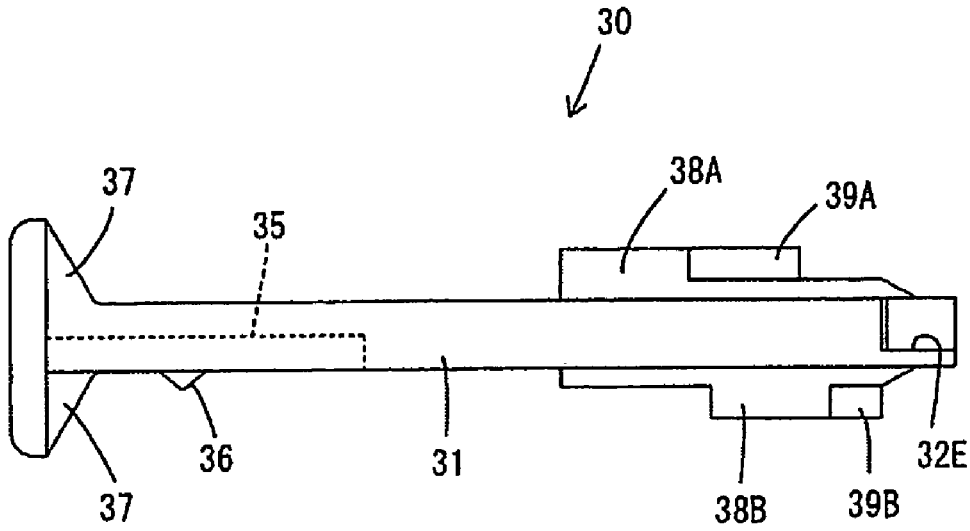
FIG. 10 is a front view of the slider.
Figure 11:
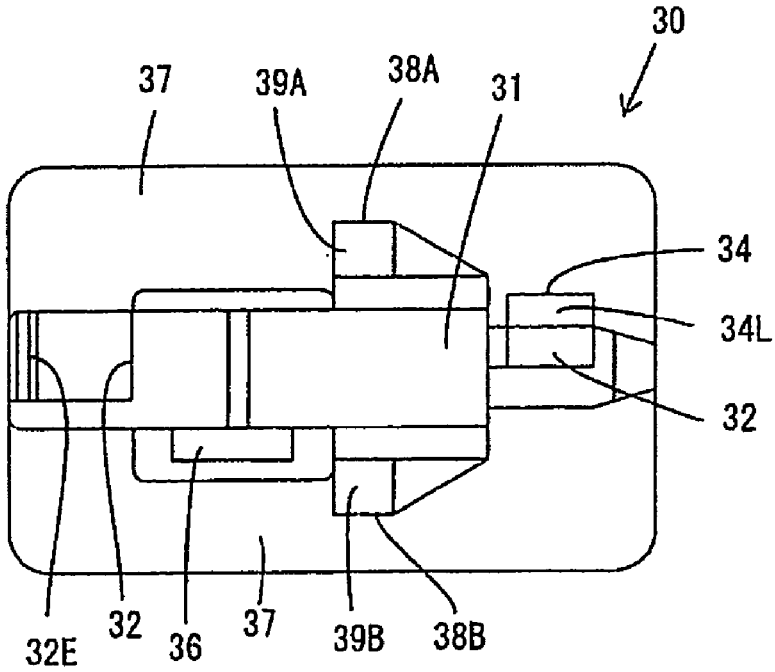
FIG. 11 is a right side view of the slider.
Figure 12:
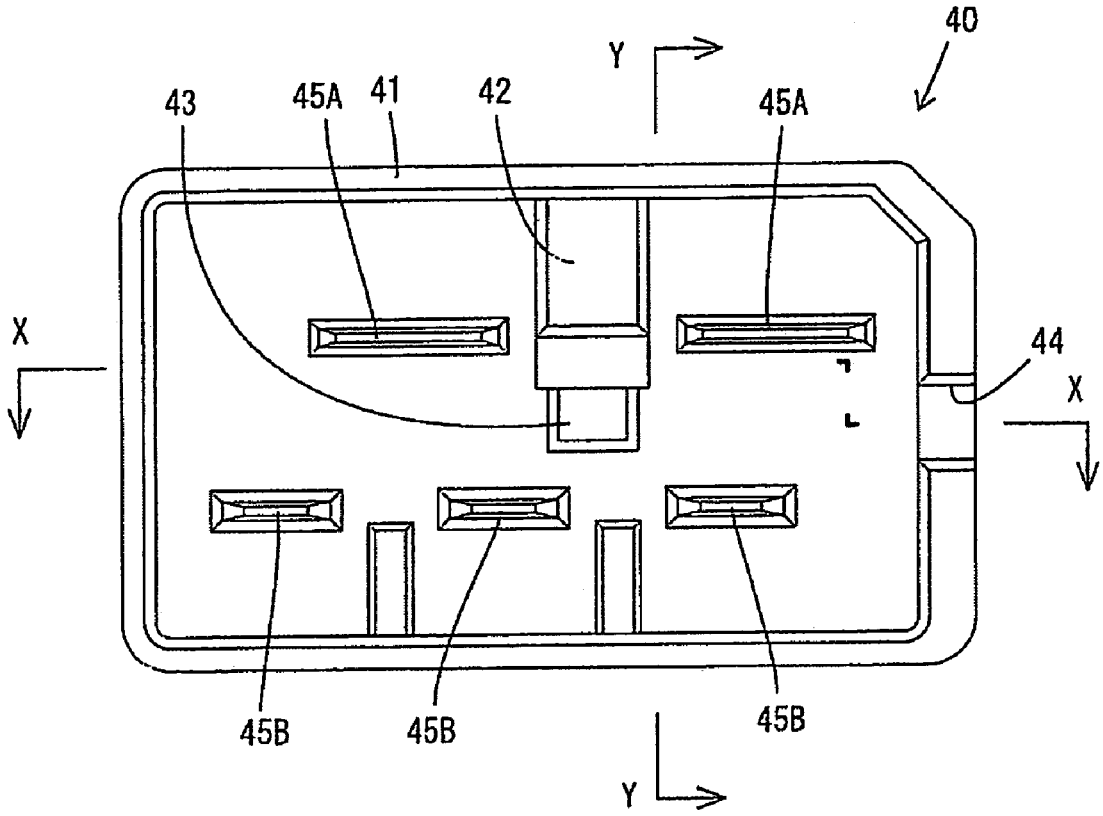
FIG. 12 is a front view of a second housing.

After all the first terminal fittings 20A, 20B are inserted, the slider 30 is inserted into the accommodation space 14 from the right and along a mounting direction that is substantially parallel to the operating direction OD. In the assembling process, the upper-stage protrusion 38A and the lower-stage protrusion 38B project into the cavities 11A, 11B through the communication holes 15A, 15B, and are moved laterally to the left and substantially perpendicular to the inserting direction ID of the first terminal fittings 20A, 20B in the cavities 11A, 11B as the slider 30 is moved in the operating direction OD. At this time, the upper-stage slanted surface 39A contacts the engaging portions 23A of any insufficiently inserted first terminal fittings 20A and presses the engaging portion 23A, as shown in FIG. 7 as the slider 30 is moved. As a result, the insufficiently inserted first terminal fitting 20A is pushed forward or in the inserting direction ID to the proper insertion position PIP (see FIG. 8) and is held retained by the lock 12A. Similarly, the lower-stage slanted surface 39B contacts the engaging portion 23B of any insufficiently inserted first terminal fitting 20B in the cavity 11B at the lower stage and moves the insufficiently inserted first terminal fitting 20B to the proper insertion position PIP. In this way, insertion of the first terminal fittings 20A, 20B into the first housing 10 is completed.

The first housing 10 then is transported to an assembling site for connection with the second housing 40. At this time, the slider 30 mounted in the accommodation space 14 is once pulled back to a partial locking position 1P shown in FIG. 1. The locking surface 34R of the partial locking projection 34 then engages the bottom end of the right inner surface of the escaping recess 16 and prevents the slider 30 from being withdrawn laterally to the right from the first housing 10. With the slider 30 held at the partial locking position 1P, the entrance 32E of the cam groove 32 is located in the escaping recess 16 and can wait on standby to be engaged with the cam follower 43.

Figure 2:
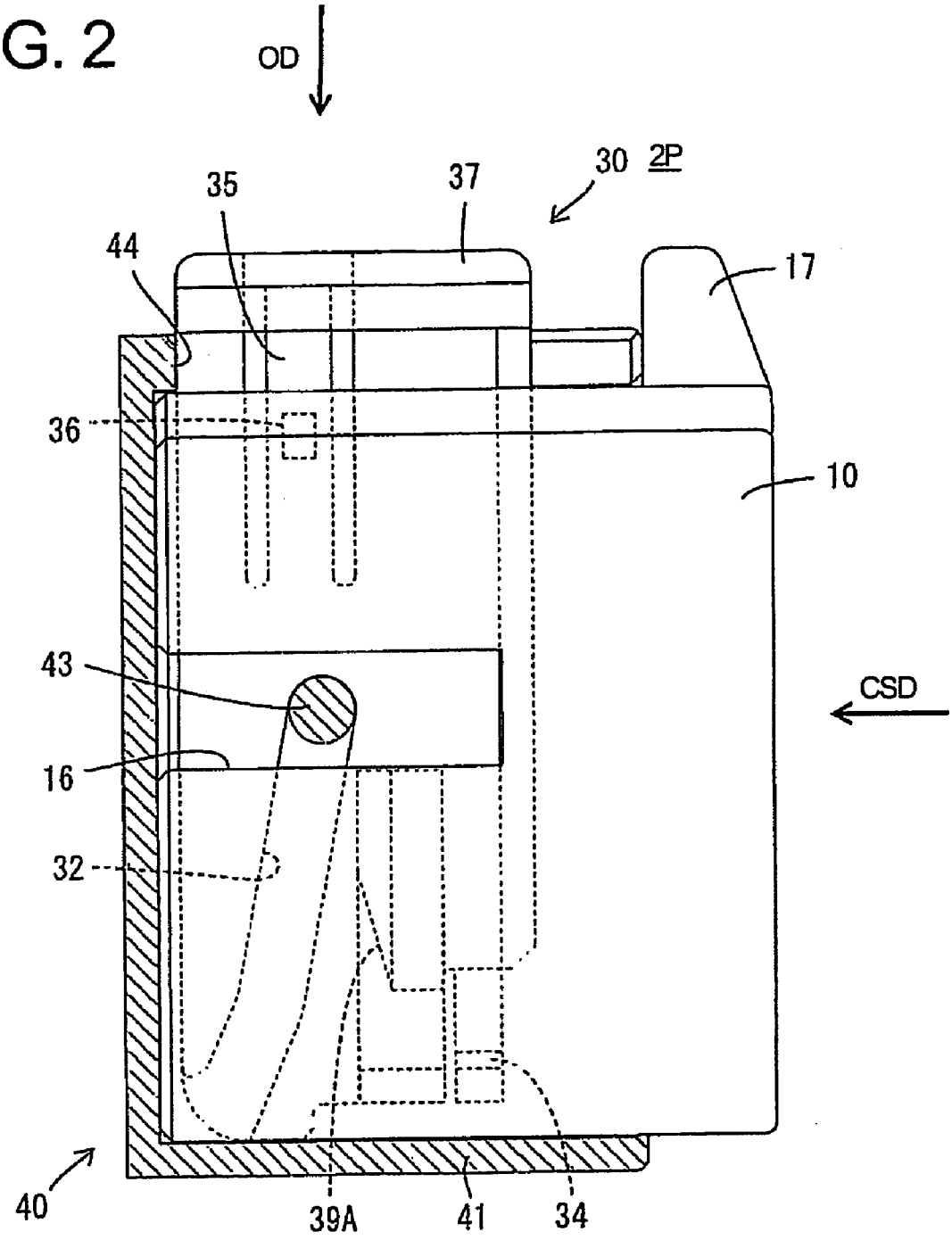
FIG. 2 is a plan view showing the slider at a full locking position.
Figure 3:
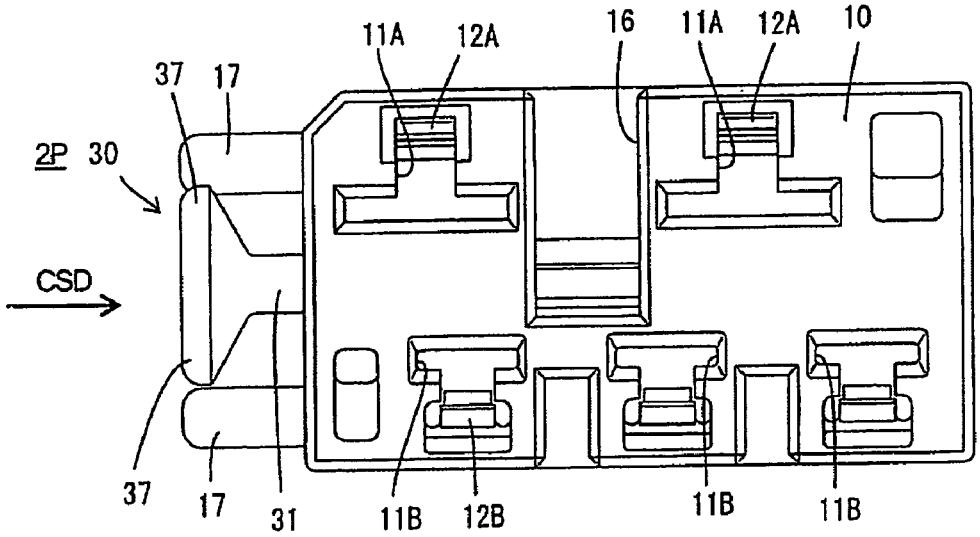
FIG. 3 is a front view showing the slider at the full locking position.
Figure 4:
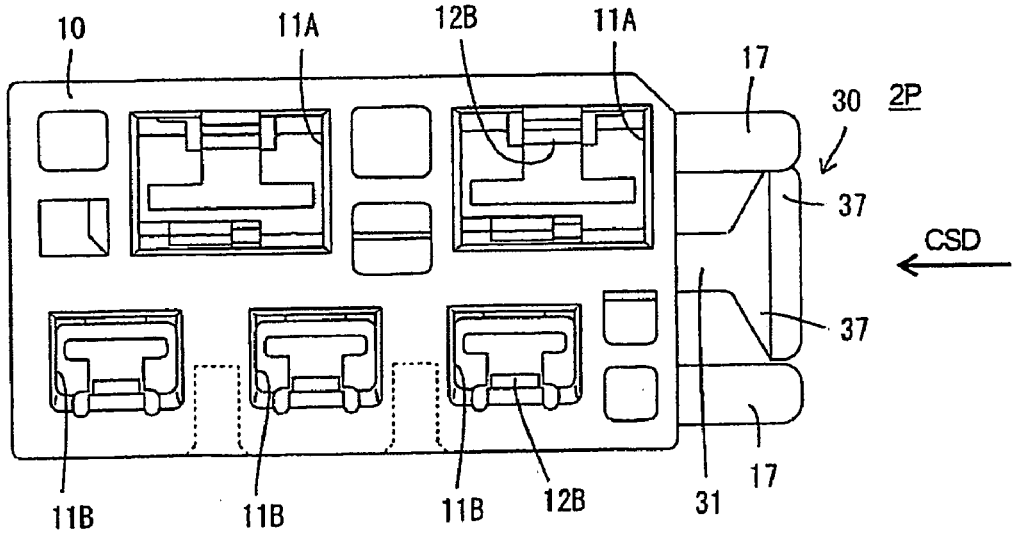
FIG. 4 is a rear view showing the slider at the full locking position.

The housings 10, 40 are connected by lightly fitting the first housing 10 into the receptacle 41 so that the cam follower 43 is inserted into the entrance 32E of the cam groove 32 while being moved relatively in the escaping recess 16. Subsequently, the knobs 37 of the slider 30 are pushed laterally from the right to push the slider 30 along the operating direction OD and into the first housing 10. The first housing 10 is pulled toward the second housing 40 as the slider 30 is moved due to a cam action between the cam groove 32 and the cam follower 43. The housings 10, 40 are connected properly when the slider 30 reaches a full locking position 2P where the left edge thereof contacts the back end of the accommodation space 14, as shown in FIG. 2. Thus, the first terminal fittings 20A, 20B and the second terminal fittings 45A, 45B are connected electrically. At this time, the full locking resilient piece 35 is deformed resiliently up and the full locking projection 36 resiliently contacts the corresponding bottom wall of the accommodation space 14 due to a resilient restoring force of the resilient piece 35. The slider 30 is held at the full locking position 2P by friction between the bottom wall of the accommodation space 14 and the full locking projection 36. The two housings 10, 40 are locked in their completely connected state by the cam action of the engagement of the cam groove 32 and the cam follower 43 when the slider 30 is at the full locking position 2P.

The knobs 37 of the slider 30 are exposed at the outer side of the receptacle 41 when the two housings 10, 40 are connected completely. However, the protecting portions 17 are present near the knobs 37, and external matter will not interfere with the knobs 37. The engaged part in the escaping recess 16 of the cam groove 32 and the cam follower 43 is covered by the receptacle 41.

The knobs 37 may be gripped to pull the slider 30 opposite to the operating direction OD against a frictional resistance between the full locking projection 36 and the bottom wall of the accommodation space 14 for separating the first housing 10 from the second housing 40. Thus, the first housing 10 moves away from the second housing 40 due to the cam action between the cam groove 32 and the cam follower 43.

As described above, the slider 30 functions as means for connecting the two housings 10, 40 and also as terminal position correcting means for moving the insufficiently inserted first terminal fittings 20A, 20B to the proper insertion positions PIP. Thus, the number of parts can be reduced as compared to a case where a separate terminal position correcting member is provided in addition to the slider 30.

The slider 30 is a single plate. Thus, the accommodation space for the slider 30 in the first housing 10 is smaller and the entire connector is small.

The slider 30 is accommodated at a substantially middle position of the first housing 10 with respect to height direction between the first terminal fittings 20A at the upper stage and the first terminal fittings 20B at the lower stage. Thus, connection resistance resulting from friction between the first terminal fittings 20A, 20B and the second terminal fittings 45A, 45B can be balanced vertically with the slider 30 as a center. Therefore, in the process of connecting the two housings 10, 40, a forcible connection resulting from relative vertical inclinations of the housings 10, 40 can be prevented.

The invention is not limited to the above described and illustrated embodiment. For example, the following modified embodiments are also embraced by the technical scope of the present invention as defined by the claims. Beside the following embodiments, various changes can be made without departing from the scope and spirit of the present invention as defined by the claims.

Although the first terminal fittings are female terminal fittings in the foregoing embodiment, they may be male terminal fittings.

The first terminal fittings are at upper and lower stages with the slider as a center in the foregoing embodiment. However, the slider may be arranged along the inner upper or lower surface of the first housing.

The slider is a single plate in the foregoing embodiment, but it may be substantially U-shaped by having a pair of plates and an operable portion connecting ends of both plates.

Although the first terminal fittings are arranged at two stages in the foregoing embodiment, they may be at one stage or at three or more stages.

The invention has been described with reference to a slider as the movable member. However, the invention is applicable to other movable members having an operation path different from a linear path (e.g. a slightly bent path, an elliptic or circular path, etc., such as a rotatable lever.

The slider is held at the full locking position by a frictional force in the foregoing embodiment, but it may be held by engagement of a lock with a corresponding lockable portion between the housing and the slider similar to the way the slider is held at the partial locking position 1P.

A second embodiment of the invention is described with reference to FIGS. 15 to 33. The second embodiment has a female housing 10, a male connector housing 150 and a slider 30 to connect and separate the two housings 10, 150. The slider 30 is to be mounted in an operating direction OD at a substantially right angle to connecting and separating directions CSD of the two housings 10, 150.

Figure 15:
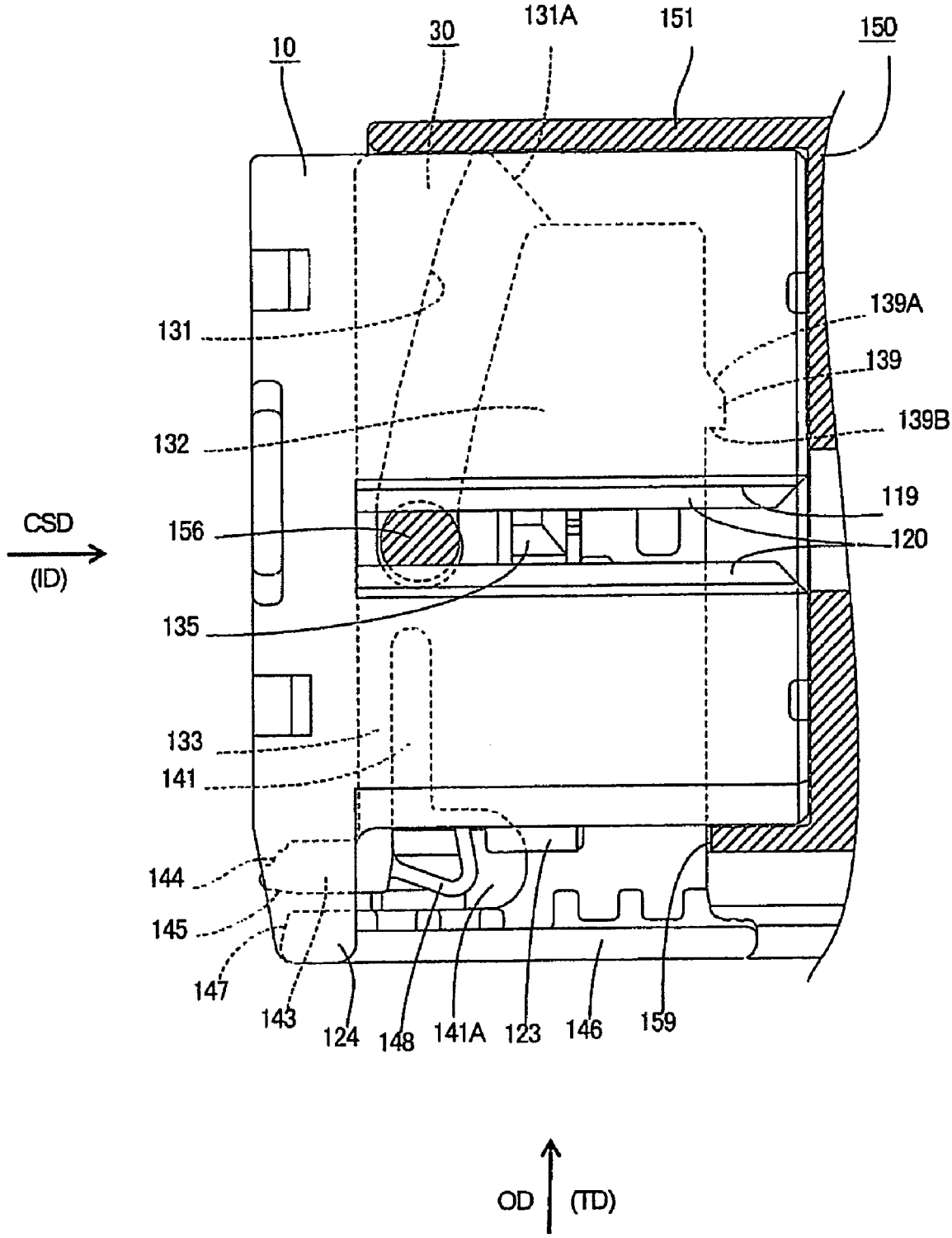
FIG. 15 is a plan view in section of a connector according to one further embodiment of the invention.
Figure 16:
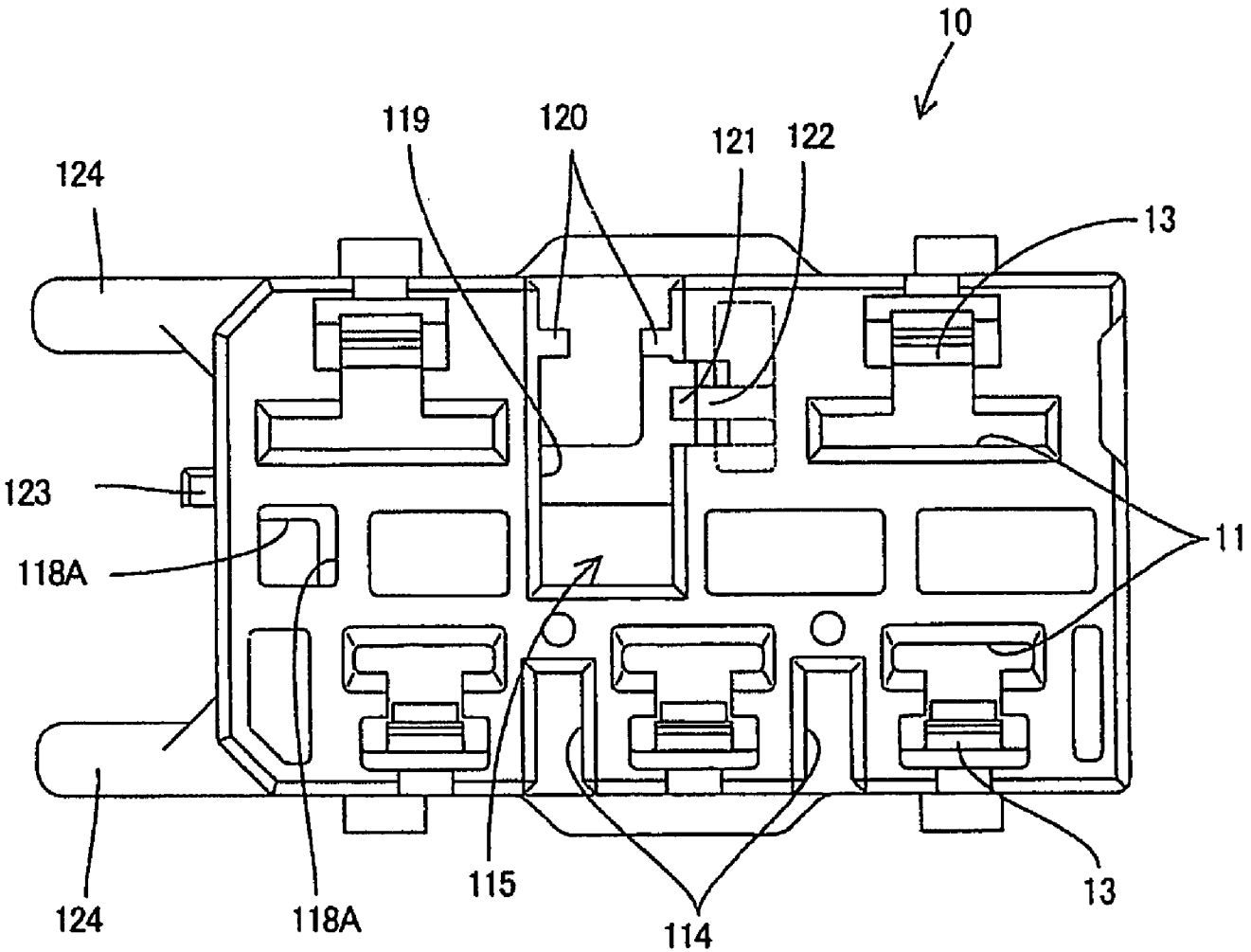
FIG. 16 is a front view of a female housing.

In the following description, ends of the two housings 10, 150 to be connected are referred to as front ends, upper and lower sides of FIG. 15 are referred to as right and left sides and upper and lower sides of FIG. 16 are referred to as upper and lower sides.

Figure 17:
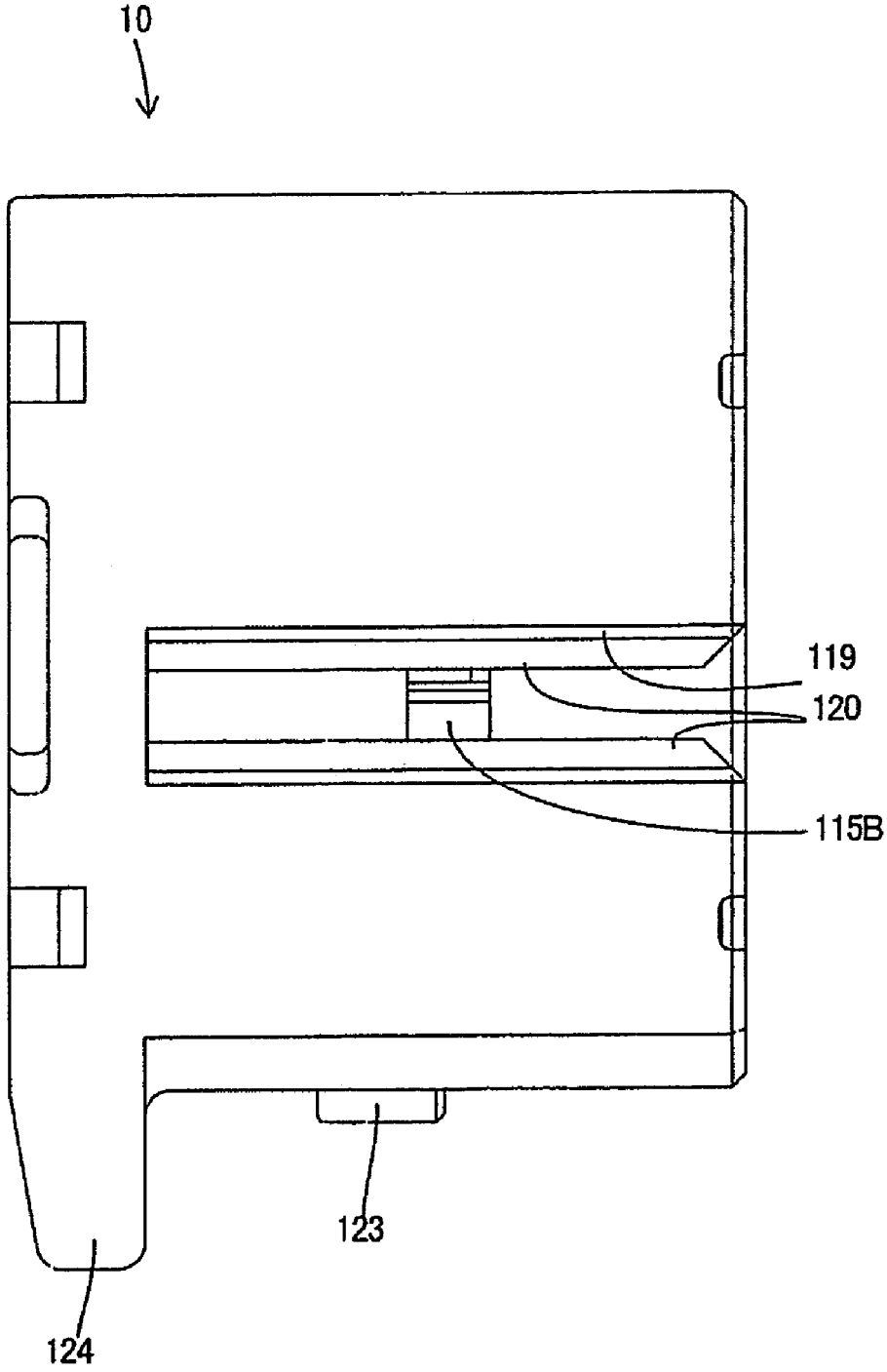
FIG. 17 is a plan view of the female housing.
Figure 18:
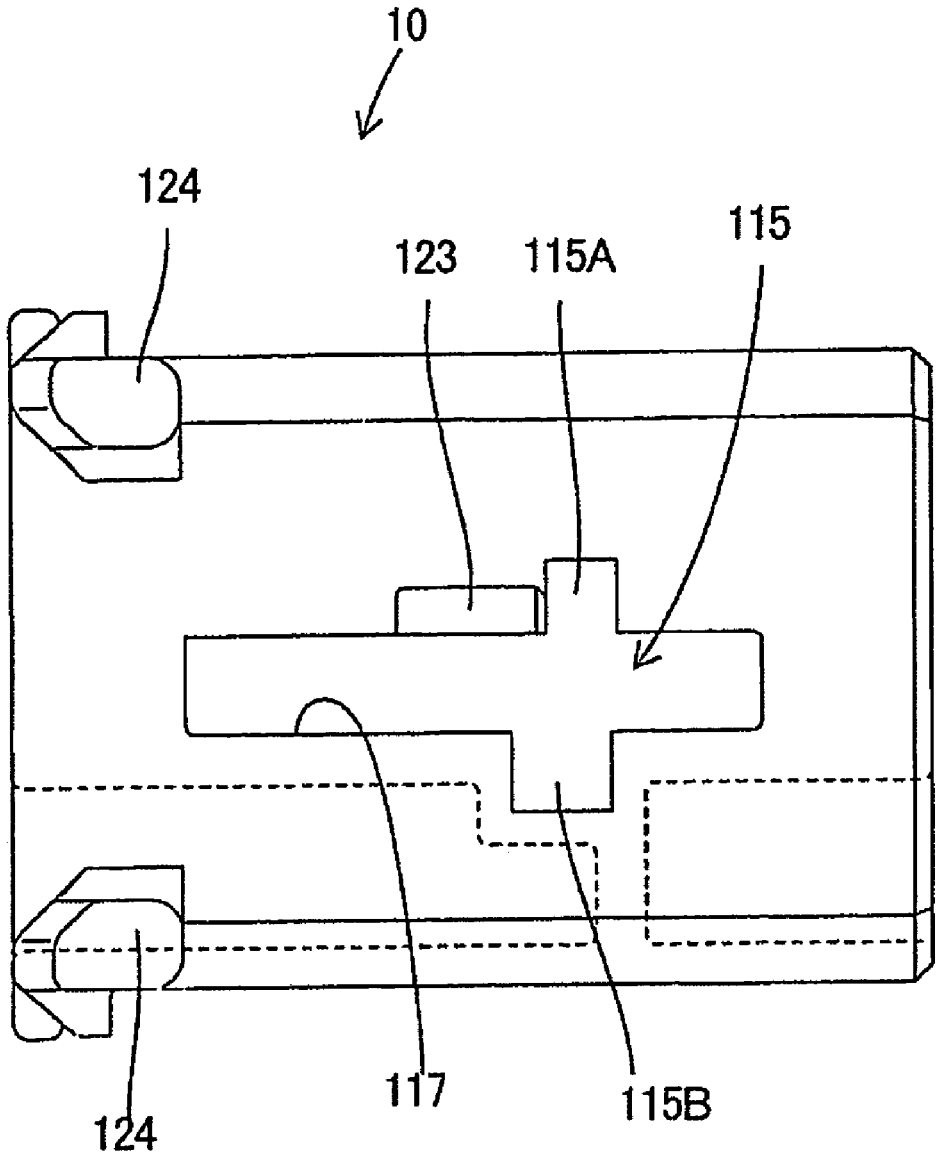
FIG. 18 is a left side view of the female housing.
Figure 19:
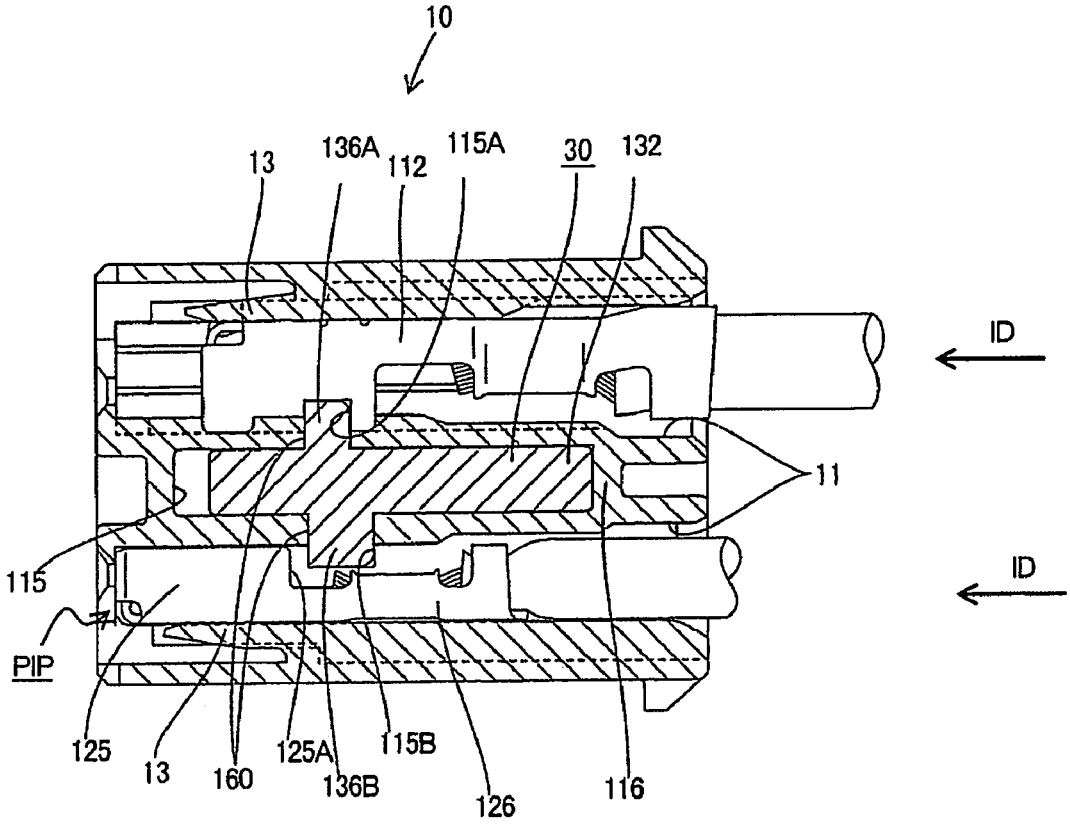
FIG. 19 is a side view in section of the female housing having female terminal fittings inserted therein.

The female housing 10 is substantially a slightly wide block, as shown in FIGS. 16 to 18. As shown in FIG. 16, cavities 11 are formed at upper and lower stages in the female housing 10. More particularly, two cavities 11 are formed at the upper stage and three cavities 11 are formed substantially side by side at the lower stage. Each cavity 11 is long in forward and backward directions and a female terminal fitting 112 is inserted therein from behind and along an inserting direction ID, as shown in FIG. 19. Locks 13 are cantilevered forward in the cavities 11 and are resiliently deformable along a direction intersecting the inserting direction ID. The locks 13 extend along upper walls of the upper stage cavities 11 and along the bottom walls of the lower stage cavities 11. Further, vertical grooves 114 extend in forward and backward directions between adjacent cavities 11 of the lower stage (see FIGS. 16 and 20) and open in the front and bottom surfaces of the female housing 10.

The female housing 10 has a slider accommodating portion 115 in which the slider 30 is to be accommodated. As shown in FIG. 19, the slider accommodating portion 115 is formed in a hollow partition wall 116 partitioning the cavities 11 at the upper stage and those at the lower stage, and has a substantially flat shape extending in a direction intersecting the cavities 11. The partition wall 116 is formed with an upper-stage communicating portion 115A communicating with the slider accommodating portion 115 and the cavities 11 at the upper stage. The partition wall 116 also has a lower-stage communicating portion 115B communicating with the slider accommodating portion 15 and the cavities 11 at the lower stage. Both communicating portions 115A, 115B extend substantially in an operating direction OD of the slider 30. The positions of the front edges of the upper-stage and lower-stage communicating portions 115A, 115B align in the vertical direction and along the operating direction OD. Upper-stage retainers 136A and lower-stage retainers 136B of the slider 30 fit into the upper-stage and lower-stage communicating portions 115A, 115B, as explained below.

Figure 21:
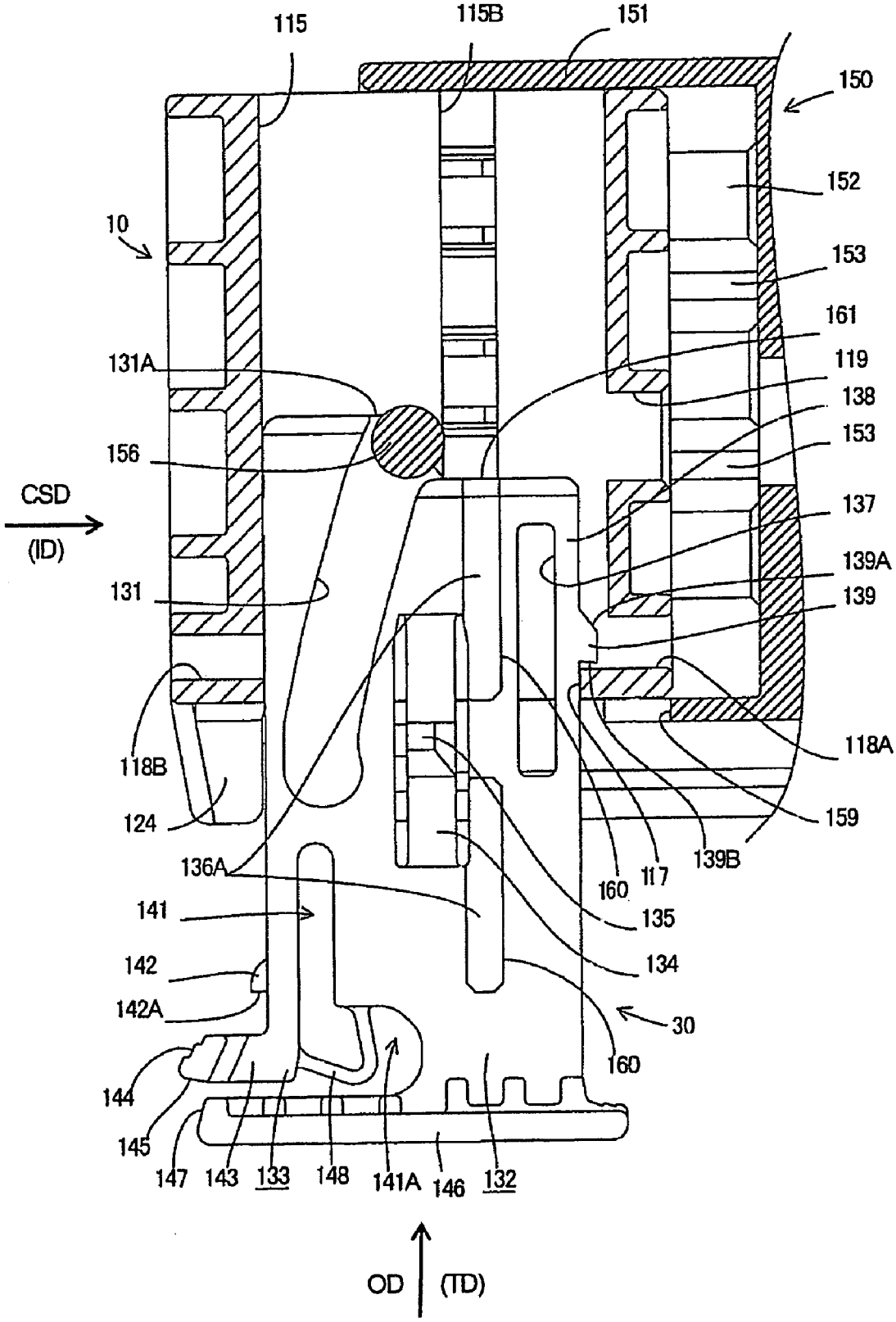
FIG. 21 is a plan view in section of the connector with a slider at a partial locking position.

The slider accommodating portion 115, and the upper-stage and lower-stage communicating portions 115A, 115B penetrate the female housing 10 in the transverse direction TD that intersects the cavities 11 and opens in the opposite left and right surfaces of the female housing 10, as shown in FIG. 21. The slider 30 is operable along the operating direction OD and hence along transverse direction TD in the slider accommodating portion 115. One of the openings in the lateral surfaces of the female housing 10 serves as a slider entrance/exit 117. The slider 30 is inserted into the slider accommodating portion 115 and withdrawn therefrom through the slider entrance/exit 117.

A front lock 118A and a rear lock 118B are provided at ends of the slider accommodating portion 115 and make openings in the front and rear surfaces of the female housing 10. A partial locking projection 139 of the slider 30 to be described later is engageable with the front lock 118A, whereas a lock projection 142 provided on a lock arm 133 of the slider 30 is engageable with the rear lock 118B.

As shown in FIGS. 16 and 17, a cam-pin introducing path 119 is recessed in a portion of the female housing 10 that partitions the left and right cavities 11 at the upper stage. The cam-pin introducing path 119 opens in the front and upper surfaces of the female housing 10 and communicates with the slider accommodating portion 115 (see FIG. 20). The cam-pin introducing path 119 is long in forward and backward directions and extends back from the front edge of the female housing 10. Additionally, the cross-sectional shape of the cam-pin introducing path 119 along a direction intersecting the forward and backward directions is substantially rectangular and slightly longer in vertical direction. Two bulges 120 are provided on the opposite side surfaces of the cam-pin inserting path 119 and extend in forward and backward directions.

Figure 20:
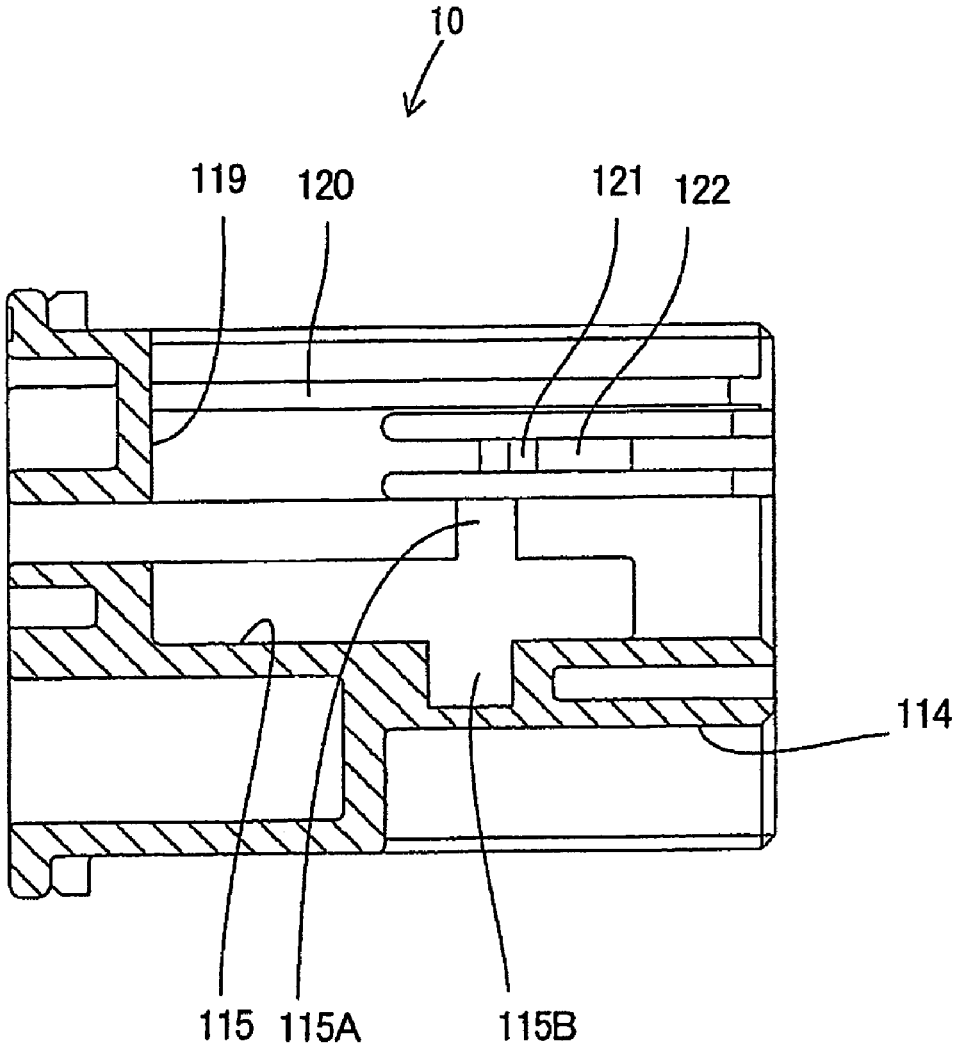
FIG. 20 is a side view in section of the female housing.

As shown in FIGS. 16 and 20, a mountain 121 is formed below the right bulge 120 and projects up to the position of the right surface of the cam-pin introducing path 119. The mountain 121 is provided on a resiliently deformable beam 122 that is supported at both ends for resiliently deformation along transverse the direction TD. The beam 122 deforms laterally to the left when the mountain 121 is pushed to the left. The two housings 10, 150 are brought close so that a cam pin 156 of the male housing 150 fits into the cam-pin introducing path 119 of the female housing 10. At this time, a curved projection 157 of the male housing 150 reaches the mountain 121. The curved projection 157 pushes the mountain 121 and deforms the beam 122 when the housings 10, 150 are brought even closer. The curved projection 157 moves over the mountain 121 as the cam pin 156 reaches an entrance 131A of a cam groove 131 in the slider 30 and gives an operator a solid feeling that the cam pin 156 was introduced into the cam groove 131.

A long rectangular temporary contact 123 projects out from the left surface of the female housing 10 along the upper edge of the slider entrance/exit 117, as shown in FIG. 18. The temporary contact 123 prevents the slider 30 from being pushed when the slider 30 is located at a partial locking position 1P and waiting on standby for engagement with the cam pin 156

Upper and lower protecting portions 124 project from the rear end of the left surface of the female housing 10.

The female terminal fitting 112 inserted into each cavity 11 is long and narrow in forward and backward directions, as shown in FIG. 19. A terminal connecting portion 125 is formed at the front portion of the female terminal fitting 112 and a wire connecting portion 126 is formed at a rear portion thereof. The wire connecting portion 126 is to be connected electrically to an end of a wire by crimping, folding, bending, insulation-displacement, soldering or the like. The terminal connecting portion 125 is substantially a rectangular tube and has a locking hole (not shown) in one side. An engaging portion 125A is formed at the rear end edge of the terminal connecting portion 125. Each female terminal fitting 112 is inserted into a cavity so that the locking hole faces the lock 113 of the corresponding cavity 11. The locks 113 engage the locking holes to retain the female terminal fittings 112 at proper positions PIP where the front ends of the female terminal fittings 112 abut the front walls of the cavities 11. At this time, the engaging portions 125A of the terminal connecting portions 125 face the front edges of the upper-stage communicating portion 115A and the lower-stage communicating portion 115B of the slider accommodating portion 115 from the front. The female terminal fittings 112 are retained completely as the upper-stage and lower-stage retainers 136A, 136B in the upper-stage and lower-stage communicating portions 115A, 115B engage the engaging portions 125A. Rear parts of the terminal connecting portions 125 face the upper-stage and lower-stage communicating portions 115A, 115B if the female terminal fittings 112 are inserted insufficiently to positions behind the proper positions PIP where locks 113 do not engage the locking holes.

Figure 22:
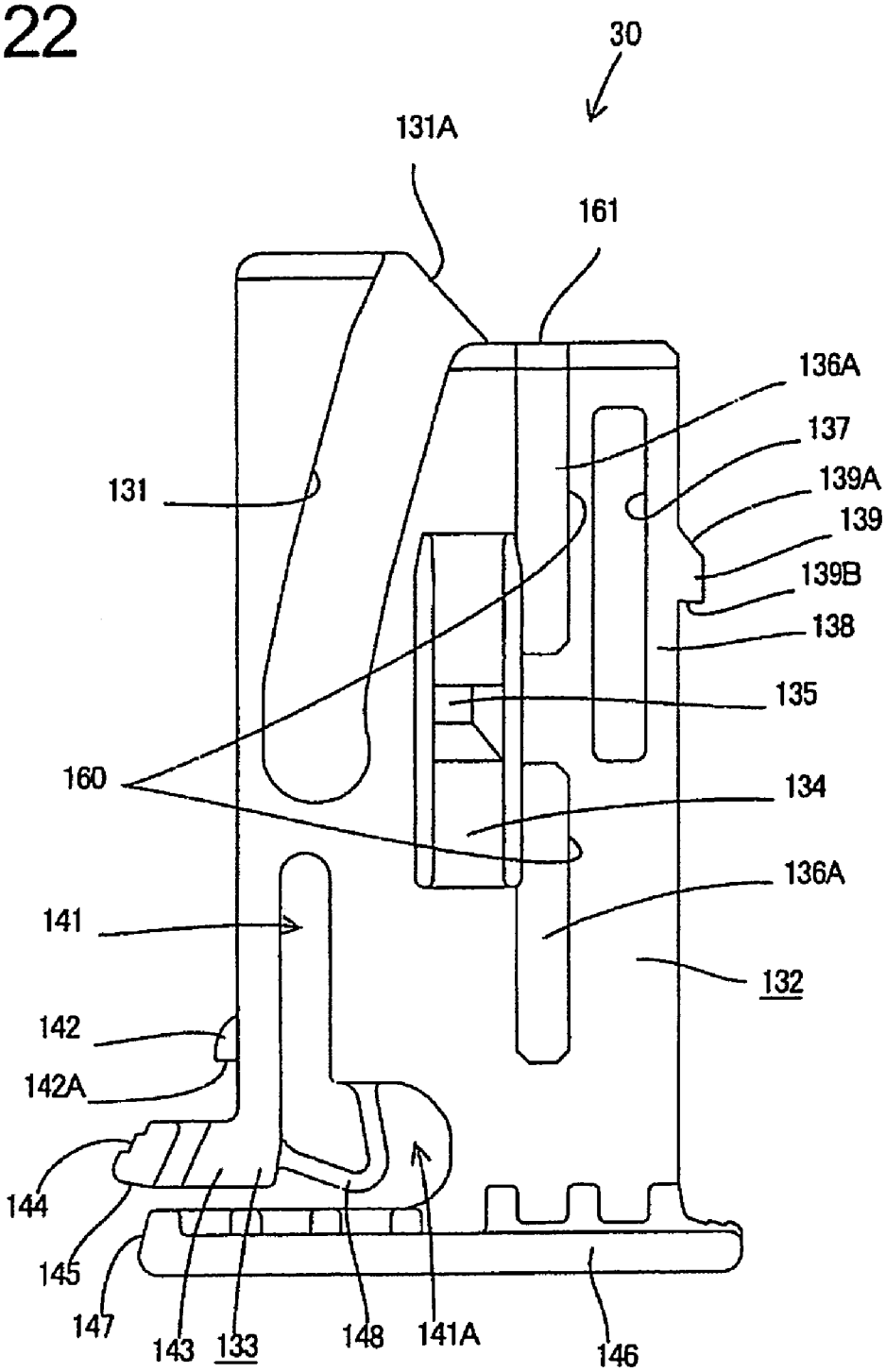
FIG. 22 is a top view of the slider.
Figure 23:
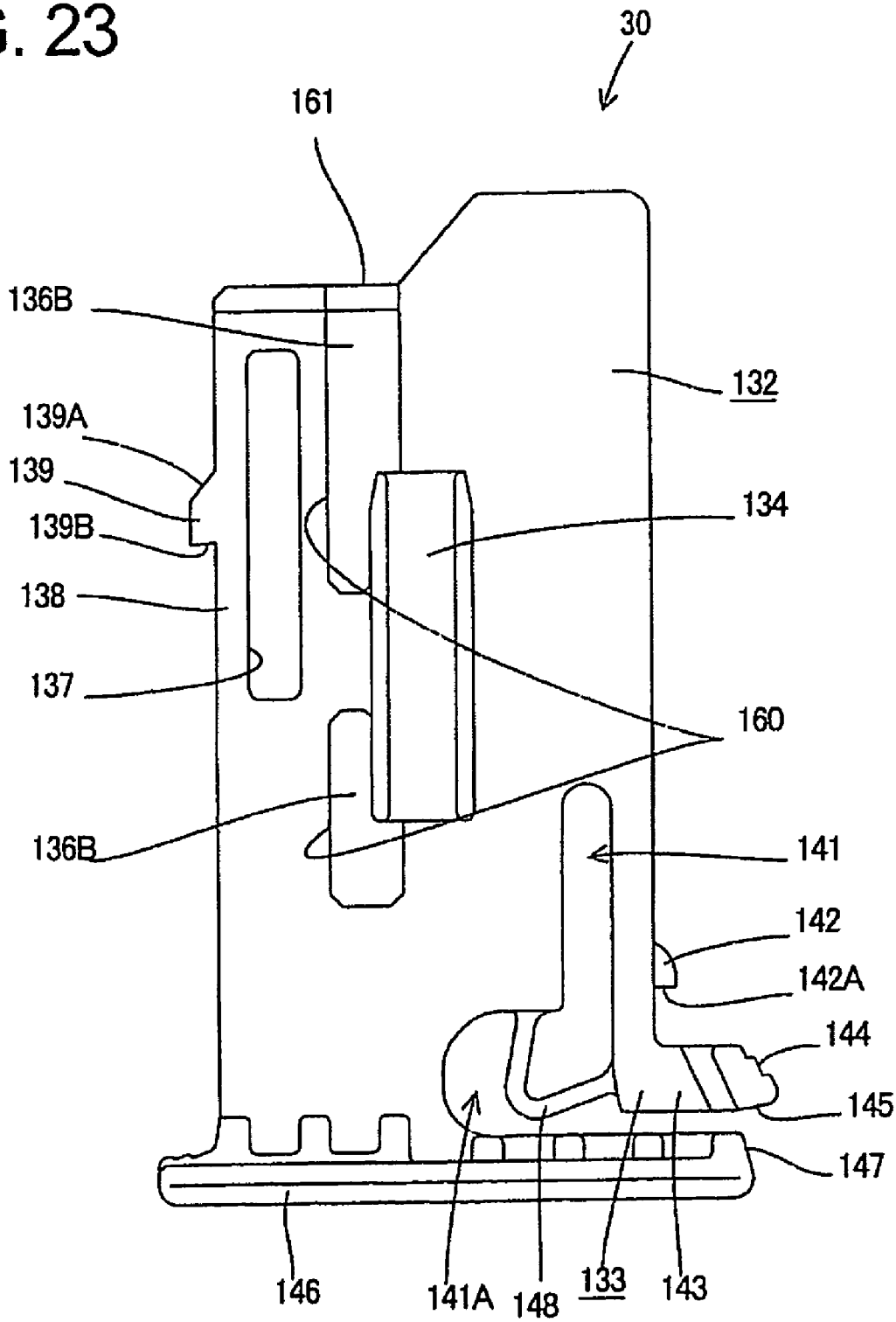
FIG. 23 is a bottom view of the slider.
Figure 24:
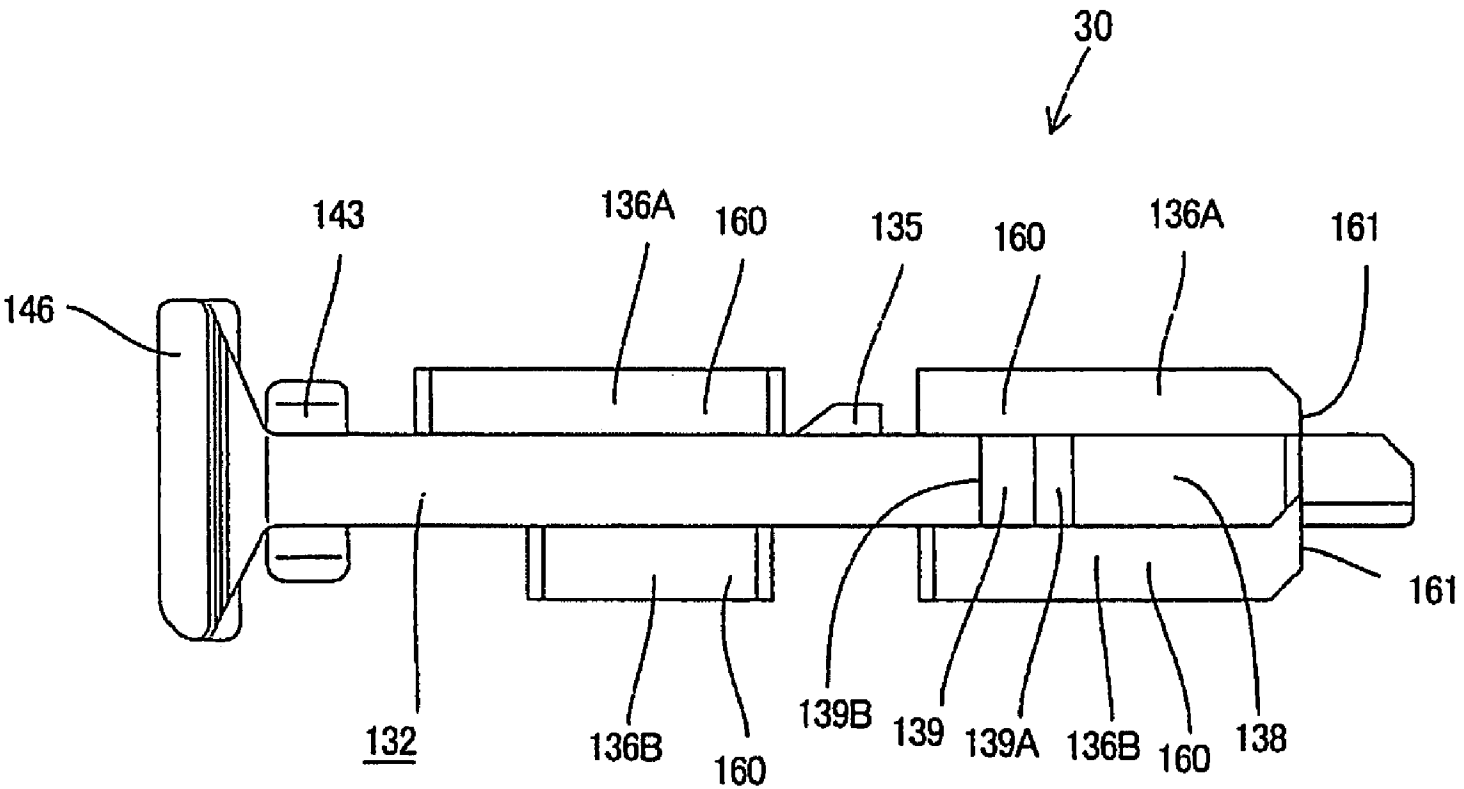
FIG. 24 is a front view of the slider.

The slider 30 is made e.g. of a synthetic resin and has a main body 132 formed with the cam groove 131 and the lock arm 133 extends from the main body 132. As shown in FIGS. 22 to 24, the slider 30 including the lock arm 133 is a substantially rectangular single plate that is wide in the transverse direction TD. The slider 30 is inserted into and withdrawn from the slider accommodating portion 115 of the female housing 10.

A resilient piece 134 is provided substantially in a middle part of the main body 132 and defines a beam supported at both lateral (left and right) ends. Thus, the resilient piece 134 is resiliently deformable vertically with the connected portions at the left and right ends as supports. A projection 135 projects up on the upper surface of the resilient piece 134.

Figure 25:
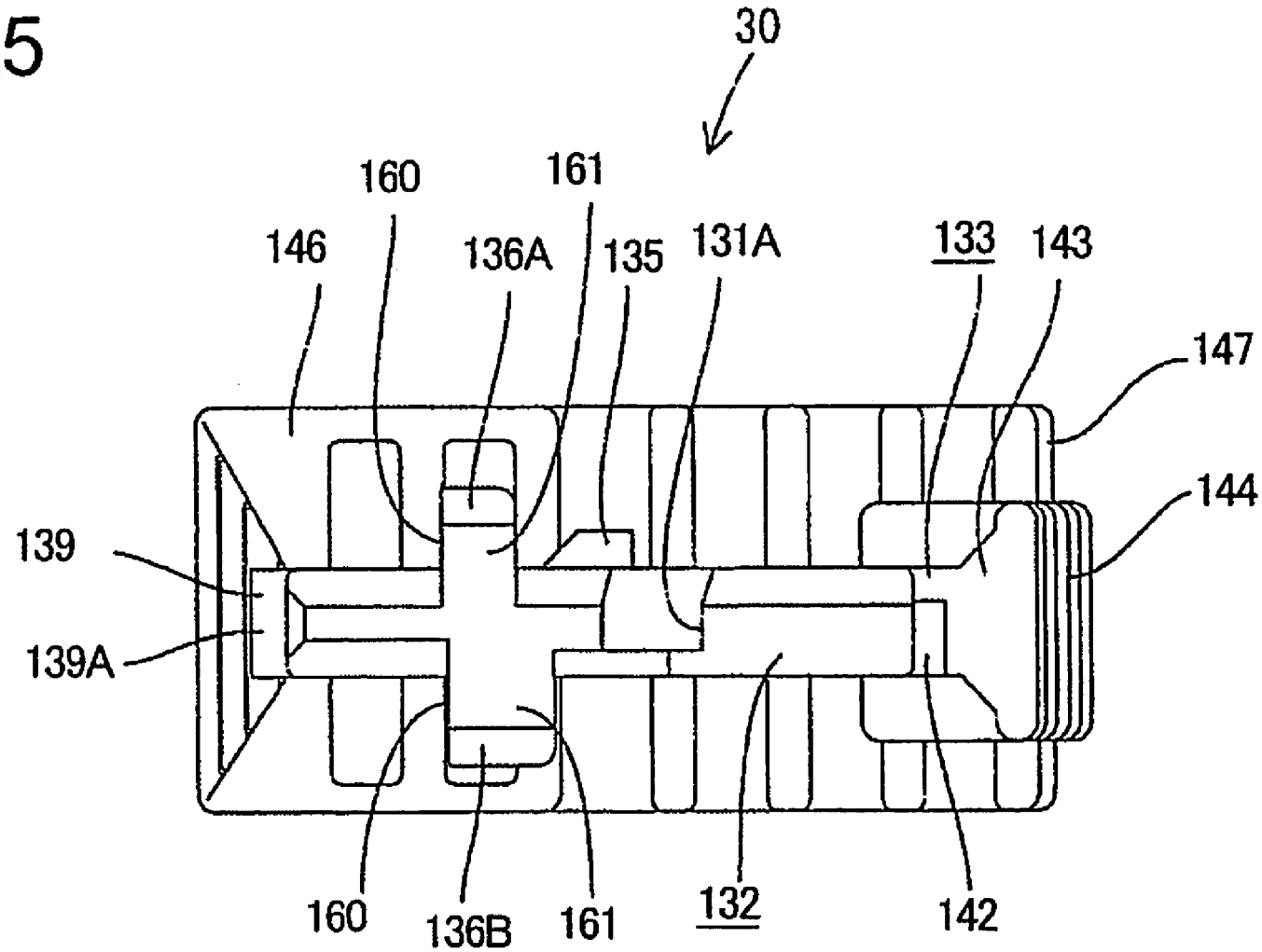
FIG. 25 is a right side view of the slider.

The upper-stage and lower-stage retainers 136A and 136B for fully locking the female terminal fittings 112 are at a front side of the resilient piece 134 on the upper and lower surfaces of the main body 132. The upper-stage and lower-stage retainers 136A and 136B are shaped to fit respectively in the upper-stage and lower-stage communicating portions 115A and 115B in the female housing 10, and are in the form of ribs that are long and narrow in the transverse direction TD, which is the operating direction OD of the slider 30, as shown in FIG. 24. Left and right upper-stage retainers 136A and left and right lower-stage retainers 136B are provided. The lower-stage retainer 136B at the left side of the projection 135 is slightly shorter in the transverse direction TD than the upper-stage retainer 136A at the left side of the projection 135. The lower-stage retainer 136B at the right side of the projection 135 has a length to extend over the two juxtaposed cavities 11. The upper-stage and lower-stage retainers 136A and 136B are on the insertion and withdrawal paths for the female terminal fittings 112 in the cavities 11 when the slider 30 is inserted completely. As shown in FIG. 25, the lower-stage retainers 136B are cross sectionally larger than the upper-stage retainers 136A, and the front ends thereof are aligned vertically with the front ends of the upper-stage retainers 136A. Locking surfaces 160 are defined at the fronts of the upper-stage and lower-stage retainers 136A, 136B and engage the engaging portions 125A of the female terminal fittings 112 in the cavities 11. Further, detecting surfaces 161 are defined at the right end of the upper-stage and lower-stage retainers 136A, 136B at the right side of the projection 135. The detecting surfaces 161 contact the terminal contacts 125 facing the upper-stage or lower-stage communicating portion 115A or 115B when the female terminal fittings 112 are inserted insufficiently and prevent a sliding movement of the slider 30 when the female terminal fittings 112 are inserted insufficiently. The insufficient insertion detecting surfaces 161 are at the front edge of the main body 132, and are substantially perpendicular to a plate-surface direction of the main body 132 from the upper-stage retainer 136A to the lower-stage retainer 136B.

As shown in FIG. 22, an opening 137 is formed at a side of the upper-stage and lower-stage retainers 136A, 136B substantially opposite to the resilient piece 134 and is long and narrow in the transverse direction TD. The opening 137 near the front end of the slider 30 with respect to the operating direction OD of the slider 30, and penetrates the main body 132 in the thickness direction. A resilient beam 138 is defined at a side of the opening 137 opposite to the upper-stage and lower-stage retainers 136A, 136B and is resiliently deformable towards the opening 137. The partial locking projection 139 projects from a side of the resilient beam 138 opposite the opening 137 and from an intermediate position along the resilient beam 138. A slanted guiding surface 139A is defined at one side of the partial locking projection 139 and a partial locking surface 139B extends perpendicular to the operating direction OD at the opposite side of the partial locking projection 139.

The cam groove 131 is recessed in the upper surface of the main body 132 of the slider 30 at a side of the resilient piece 134 opposite to the upper-stage and lower-stage retainers 136A, 136B. The cam groove 131 extends back oblique to operating direction OD of the slider 30 and the connecting direction CD of the female housing 10. Thus, the housings 10, 150 are connected more deeply as the slider 30 is moved in the operating direction OD. The entrance 131A of the cam groove 131 is at an intermediate position of the right edge of the main body 132, and an end of the cam groove 131 opposite the entrance 131A is at a transverse intermediate position of an end portion corresponding to the rear end of the slider accommodating portion 115.

The lock arm 133 is at the left rear side of the cam groove 131 with respect to the operating direction OD of the slider 30. The lock arm 133 is cantilevered back in the operating direction OD of the slider 30 from a position near the transverse center of the main body 132, and is resiliently deformable along the plate-surface direction of the main body 132. An extending end of the lock arm 133 reaches the vicinity of the left end of the main body 132.

A deformation space 141 of substantially constant width is defined between the lock arm 133 and the lateral edge of the main body 132 to accommodate resilient deformation of the lock arm 133. The deformation space 141 has an open left side, and a hinge accommodating portion 141A is defined at the left side of the deformation space 141.

The lock 142 projects from a surface of the lock arm 133 opposite the deformation space 141 and is at a relatively low position on the surface of the lock arm 133 (see FIG. 25). The front side of the lock 142 with respect to the operating direction OD of the slider 30 is slanted, but the rear surface is aligned substantially normal to the operating direction OD of the slider 30. The lock 142 fits into the rear lock 118B of the slider accommodating portion 115 when the slider 30 reaches a full locking position 2P, and the locking surface 142A is substantially opposed to the left surface of the rear lock 118B. Thus, the slider 30 is retained and, as a result, the slider 30 and the female housing 10 are locked in their properly connected state. However, the lock arm 133 can be pushed towards the deformation space 141 to disengage the lock 142 from the rear lock 118B and to unlock the slider 30.

A hand-push portion 143 is formed at the extending end of the lock arm 133 and is bent away from the main body 132, and this bent portion serves as a hand-push or operable portion 143 operated or operable to push the lock arm 133. An inclined finger-placing surface 144 is formed at the leading end of the hand-push portion 143 for receiving a manual pushing force. As shown in FIG. 22, the finger-placing surface 144 has a stepped nonslip surface.

A projecting distance of the hand-push portion 143 in a direction opposite to the resilient deforming direction of the lock arm 133 is set such that the leading end of the hand-push portion 143 bulges out from a covering portion 146 to be described later. An escaping surface 145 is defined at the left rear of the hand-push portion 143 and is inclined moderately forward towards its leading end with respect to the operating direction OD of the slider 30. An external force on the escaping surface 145 from back side with respect to the operating direction OD of the slider 30 will have a component for displacing the lock arm 133 toward the deformation space 141.

The plate-shaped cover 146 is provided at the rear end of the main body 132 with respect to the operating direction OD of the slider 30 and is substantially perpendicular to the plate-surface of the main body 132. As shown in FIG. 25, the cover 146 is a rectangle that is long in forward and backward directions and bulges up, down, left and right from the main body 132. The cover 146 is spaced slightly from end of the lock arm 133. Additionally, the cover 146 covers the rear end of the main body 142 and substantially all of the lock arm 133 except the leading end of the hand-push portion 143. The cover 146 also functions as a pushable wall to be pushed by finger for inserting the slider 30 into the slider accommodating portion 115. A finger-supporting surface 147 is formed at a side of the cover 146 corresponding to the hand-push portion 143 and can receive part of the finger that pushes the hand-push portion 143 for unlocking the slider 30. The finger-supporting surface 147 is inclined towards the front with respect to the operating direction OD of the slider 30, similar to the finger-placing surface 144 of the hand-push portion 143. The finger-placing surface 144 and the finger-supporting surface 147 constitute a substantially continuous downward gradient towards the front with respect to the operating direction OD of the slider 30 when the hand-push portion 143 is pushed to unlock the slider 30. Thus, both the finger-placing surface 144 and the finger-supporting surface 147 extent substantially along a finger obliquely placed from the finger-placing surface 144 of the hand-push portion 143 to the finger-supporting surface 147 of the cover 146.

The lock arm 133 and the main body 132 are coupled via a hinge 148. One end of the hinge 148 is coupled to the extending end of the lock arm 133 and the other end thereof is coupled to an edge of the main body 132 at the hinge accommodating portion 141A. The hinge 148 has a V-shape with an apex in the hinge accommodating portion 141A. The hinge 148 has an extended length that prevents the lock arm 133 from being displaced excessively away from the main body 132.

Figure 26:
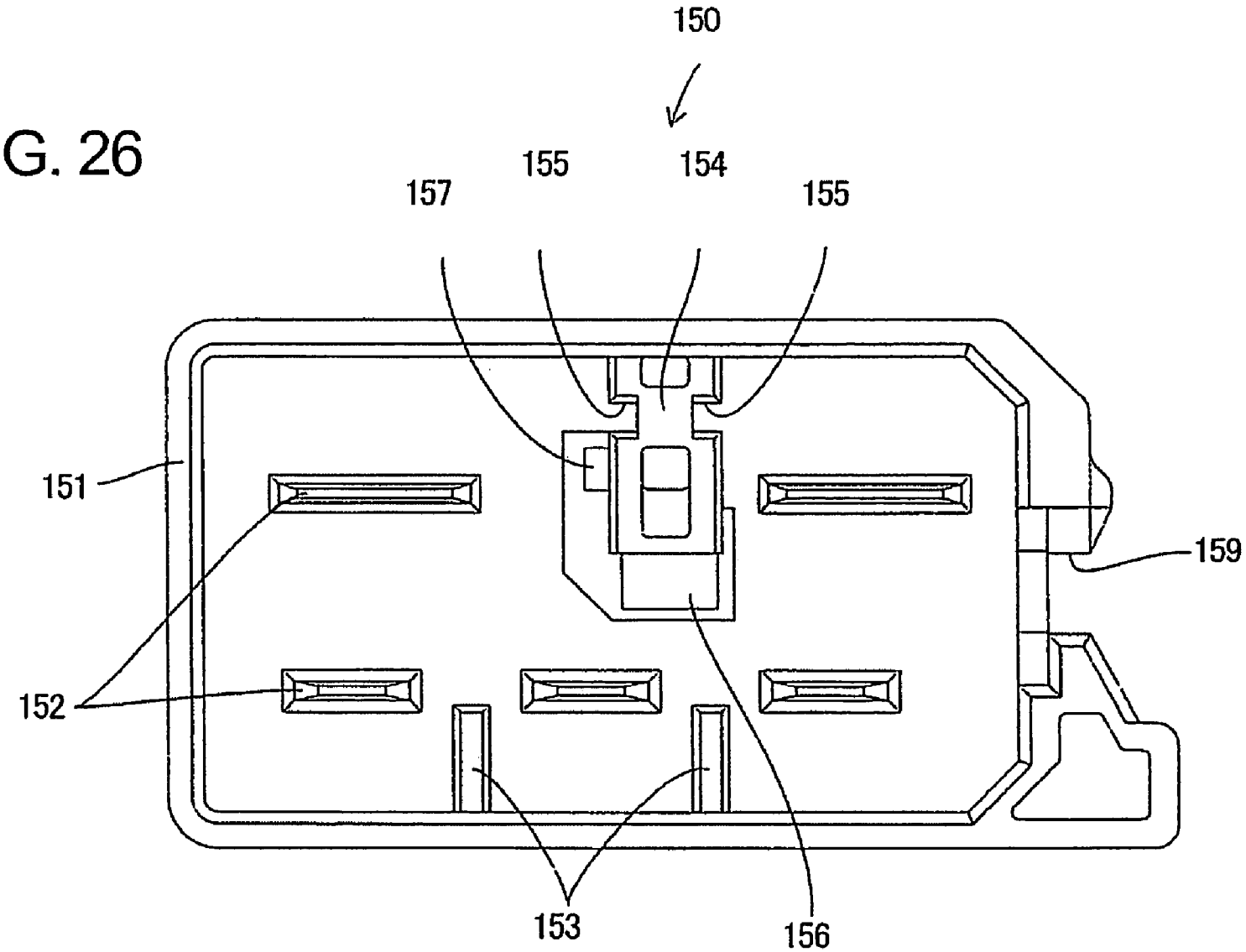
FIG. 26 is a front view of a male housing.
Figure 27:
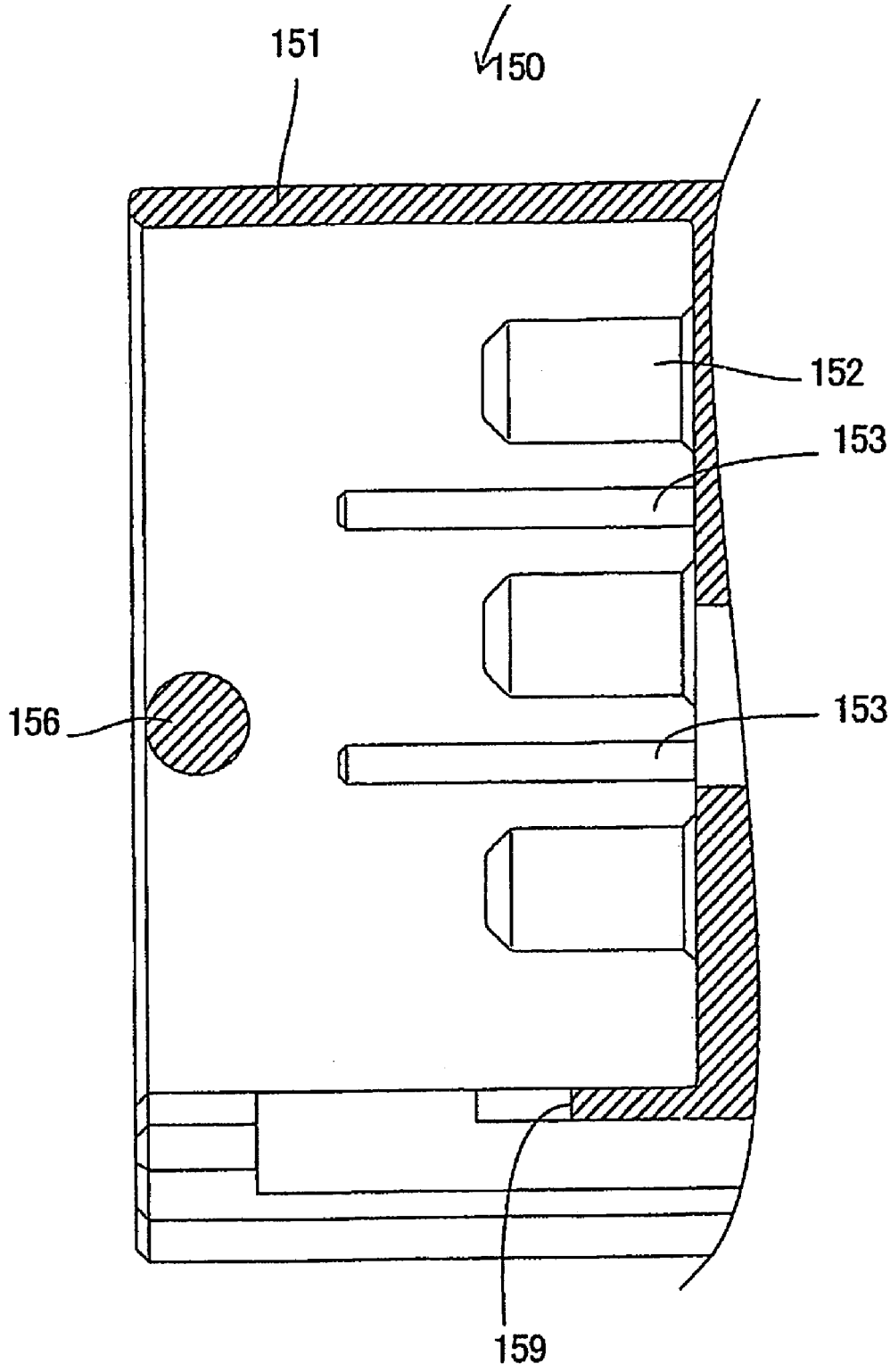
FIG. 27 is a plan view in section of the male housing.
Figure 28:
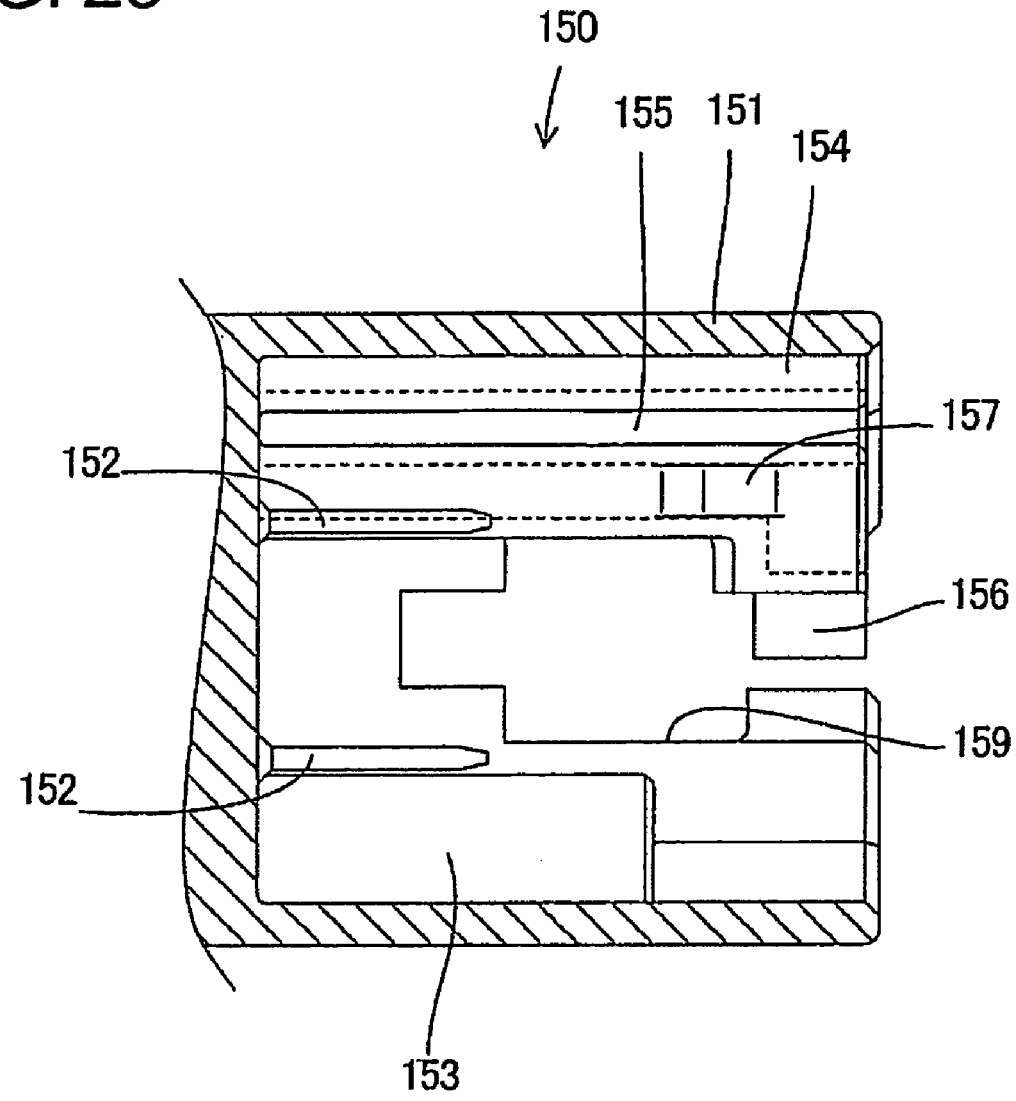
FIG. 28 is a side view in section of the male housing.

The male housing 150 is to be fixed to a device (not shown) of an automotive vehicle, and includes a rectangular tubular receptacle 151 that projects forward from a wall surface of the device, as shown in FIGS. 26 to 28. Male terminal fittings 152 are mounted in the male housing 150 and have tab-shaped leading ends that project forward in the receptacle 151. The male terminal fittings 152 are arranged at upper and lower stages corresponding to the female terminal fittings 112.

Ribs 153 extend in forward and backward directions on the inner bottom surface of the receptacle 151. The ribs 153 are arranged between adjacent male terminals 152 at the lower stage and fit into the grooves 114 of the female housings 10 during connection of the housings 10, 150 to prevent a forcible connection.

A supporting projection 154 projects down from the upper wall of the receptacle 151. The supporting projection 154 is arranged between two male terminal fittings 152 at the upper stage and extends from the front edge to the rear edge of the receptacle 151. Additionally, the supporting projection 154 has a substantially rectangular cross section that is slightly longer in the vertical direction when viewed from the front. Two narrow grooves 155 are formed on opposite left and right surfaces of the supporting projection 154 near the upper end and extend in forward and backward directions. The grooves 155 can receive bulges 120 in the cam-pin introducing path 119.

The cam pin 156 projects down near the front end of the supporting projection 154 and has a substantially cylindrical shape with a central axis extending vertically and perpendicular to the connecting direction CSD of the two housings 10, 150.

The curved projection 157 is a position near the front end of the supporting projection 154 and has a shape of a moderately sloped mountain. The curved projection 157 is provided below the right groove 155.

A slot 159 extends back from the front edge of the receptacle 151 and has a dimension as long as the shorter side of the main body 132 of the slider 30, so that interference with the slider 30 can be avoided during connection of the two housings 10, 150.

The connector is assembled by inserting the female terminal fittings 112 into the respective cavities 11 from behind and along the inserting direction ID. Each female terminal fitting 112 inserted to the proper position is partly locked by the respective lock 113. The slider 30 then is held in an orientation so that the upper-stage and lower-stage retainers 136A and 136B fit respectively into the upper-stage and lower-stage communicating portions 115A and 115B of the slider accommodating portion 115. The slider 30 then is inserted through the slider entrance/exit 117 and is pushed along the operating direction OD by fingers placed on the cover 146.

Figure 29:
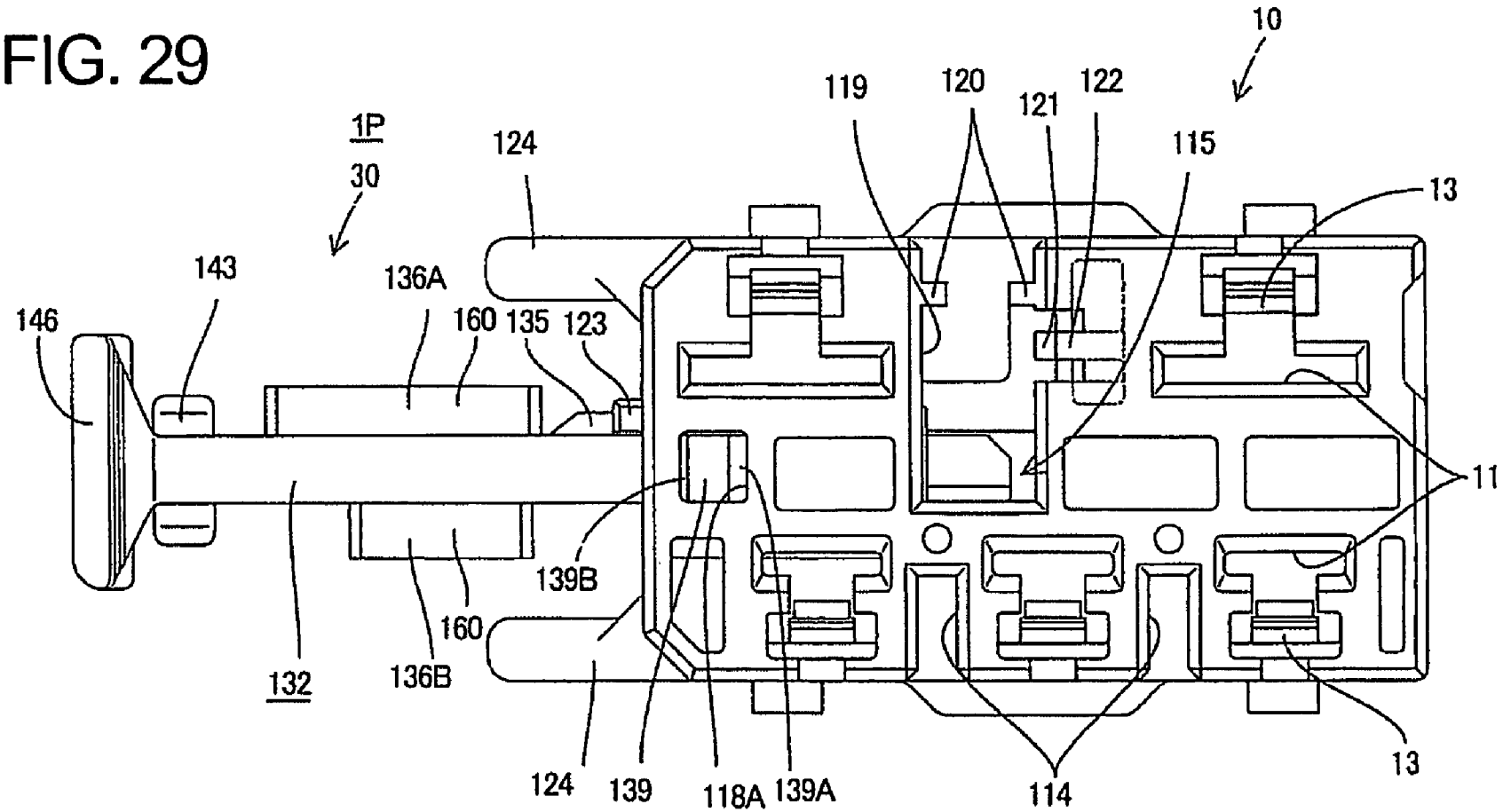
FIG. 29 is a front view showing a state reached by inserting the slider to a partial locking position or first position in the female housing.
Figure 30:
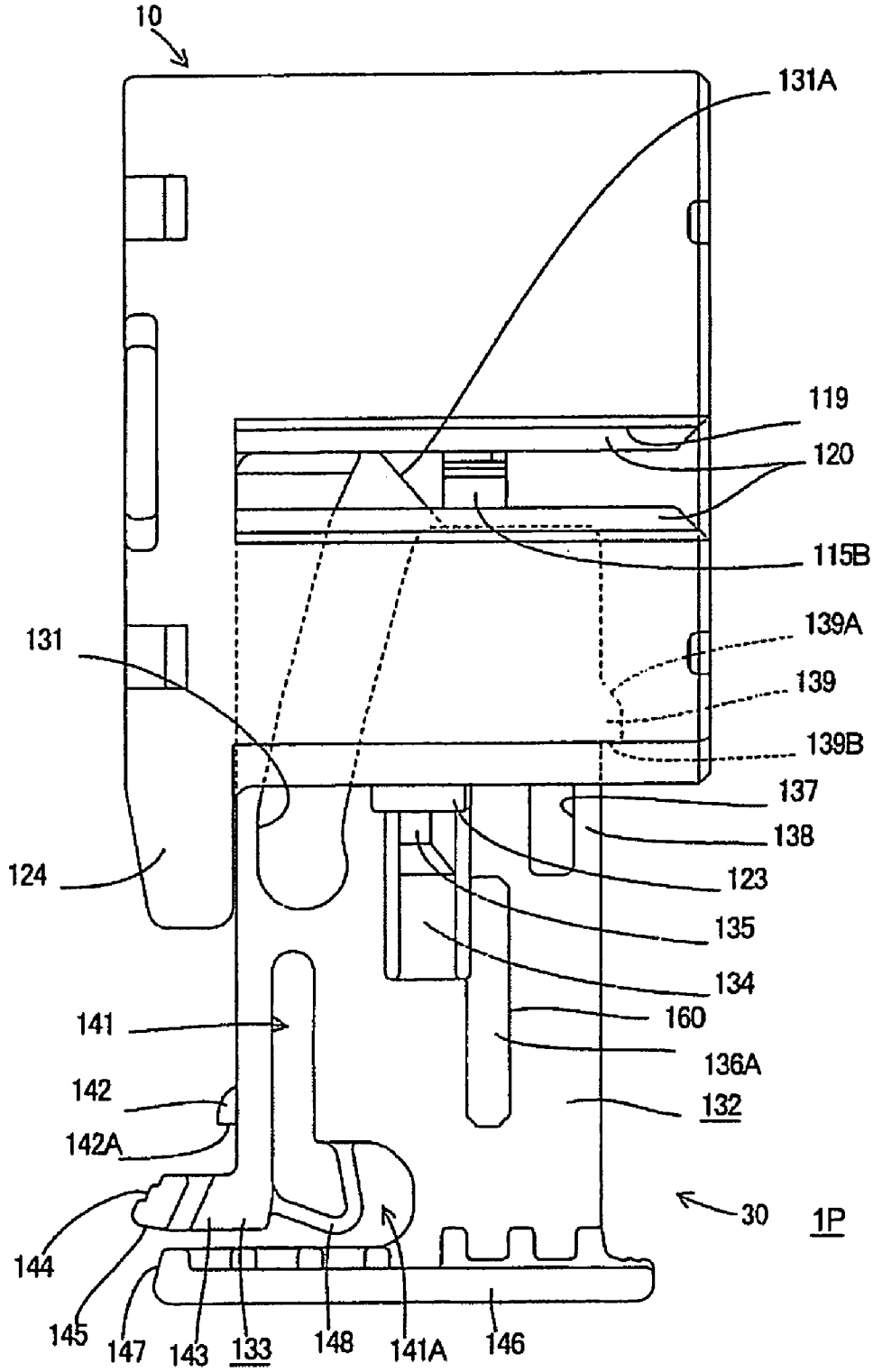
FIG. 30 is a plan view showing the state reached by inserting the slider to the partial locking position or first position in the female housing.

As the slider 30 is inserted, the upper-stage and lower-stage retainers 136A and 136B gradually pass the upper-stage and lower-stage communicating portions 115A and 115B. The partial locking projection 139 on the slider 30 moves over the peripheral edge of the slider entrance/exit 117 and fits into the front lock 118A. Thus, the partial locking surface 139B of the partial locking projection 139 opposes the left surface of the front lock 118A and, simultaneously, the projection 135 on the upper surface of the slider 30 contacts the temporary contact 123 on the upper edge of the slider entrance/exit 117, as shown in FIGS. 29 and 30. At this time, the entrance 131A of the cam groove 131 is in the cam-pin introducing path 119 and is engageable with the cam pin 156 of the male housing 150. Further, the locking surfaces 160 of the upper-stage and lower-stage retainers 136A and 136B at the right side of the projection 135 in the upper-stage and lower-stage communicating portions 115A and 115B engage the engaging portions 125A of the female terminal fittings 112 in the cavities 11 at the left side of the cam-pin introducing path 119 to doubly lock these female terminal fittings 112. On the other hand, the female terminal fittings 112 in the cavities 11 at the right side of the cam-pin introducing path 119 are not fully locked, i.e. the slider 30 is at a retracted position where the female terminal fittings 112 can be inserted into and withdrawn from the cavities 11 at the right side of the cam-pin introducing path 119. In this way, the slider 30 is held at the partial locking position where the cam groove 131 waits on standby for engagement with the cam pin 156 and cannot move transversely relative to the slider accommodating portion 115. It is not always necessary to insert the female terminal fittings 112 into the cavities 11 at the front side with respect to the inserting direction or operating direction OD of the slider 130 before the slider 30 is operated. It is also possible to insert the female terminal fittings 112 after the slider 30 is inserted and held at the partial locking position.

The female housing 10 may be transported to an assembling site for connection with the male housing 150. At this time, a rear portion of the slider 30 with respect to the operating direction OD of the slider 130 is exposed from the female housing 10. Here, the lock arm 133 is mostly covered by the cover 146 from behind. Thus, foreign matter that approaches from behind contacts the cover 146, and will not interfere with the lock arm 133. Foreign matter that approaches from a side opposite to the deformation space 141 is likely to contact the peripheral edge of the cover 146 before interfering with the lock arm 133. Therefore, a possibility of a foreign matter directly contacting the lock arm 133 is reduced as compared to a case where the lock arm is completely exposed.

Foreign matter approaching from behind contacts may contact the escaping surface 145 at the leading end of the hand-push portion 143. An external force acting forward from the back on the escaping surface 145 has a component that acts towards the deformation space 141. This component causes the lock arm 133 to displace toward the deformation space 141. Thus, displacement of the lock arm 133 in an opposite direction can be avoided.

Even if the lock arm 133 should displace in the opposite direction, the hinge 148 prevents plastic deformation of the lock arm 133.

Figure 31:
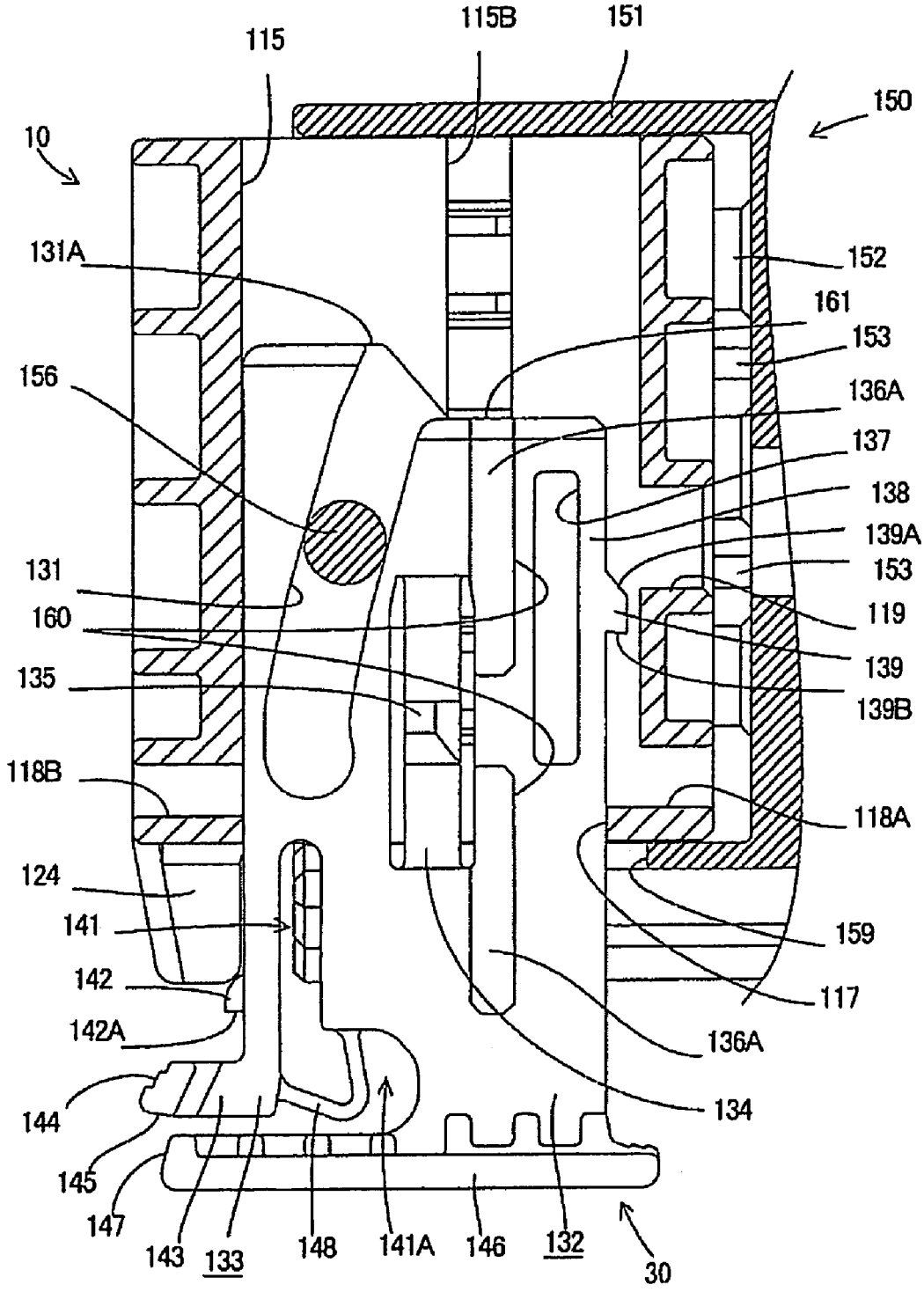
FIG. 31 is a plan view in section showing a state during movement of the slider from the partial locking position to a full locking position.

The female housing 10 is fit lightly into the receptacle 151 to insert the cam pin 156 into the cam-pin introducing path 119, and the two housings 10, 150 are brought closer until the cam pin 156 reaches the entrance 131A of the cam groove 131. At this time, the curved projection 157 moves over the mountain 121. The operator feels this action to obtain a solid feeding that the cam pin 156 was introduced into the entrance 131A of the cam groove 131. The cover 146 of the slider 30 is pushed by hand from the left side after the cam pin 156 and the cam groove 131 engage. The resilient piece 134 of the slider 30 then is deformed resiliently down and the projection 135 moves over the temporary contact 123. Thus, the slider 30 is unlocked and can be pushed laterally to the right. As the slider 30 is moved, the female housing 10 and the male housing 150 are pulled towards each other by a cam action of the engagement of the cam groove 131 and the cam pin 156 as shown in FIG. 31.

The terminal connecting portion 125 of any insufficiently inserted female terminal fitting 112 faces the upper-stage communicating portion 115A or the lower-stage communicating portion 115B. Thus, the insufficient insertion detecting surface 161 of the upper-stage retainer 136A or the lower-stage retainer 136A contacts this terminal connecting portion 125 (see FIG. 19). As a result, the upper-stage retainer 136A or the lower-stage retainer 36A cannot move any further forward, and further the insertion of the slider 30 is prevented to indicate the insufficiently inserted state of the female terminal fitting 12.

Figure 32:
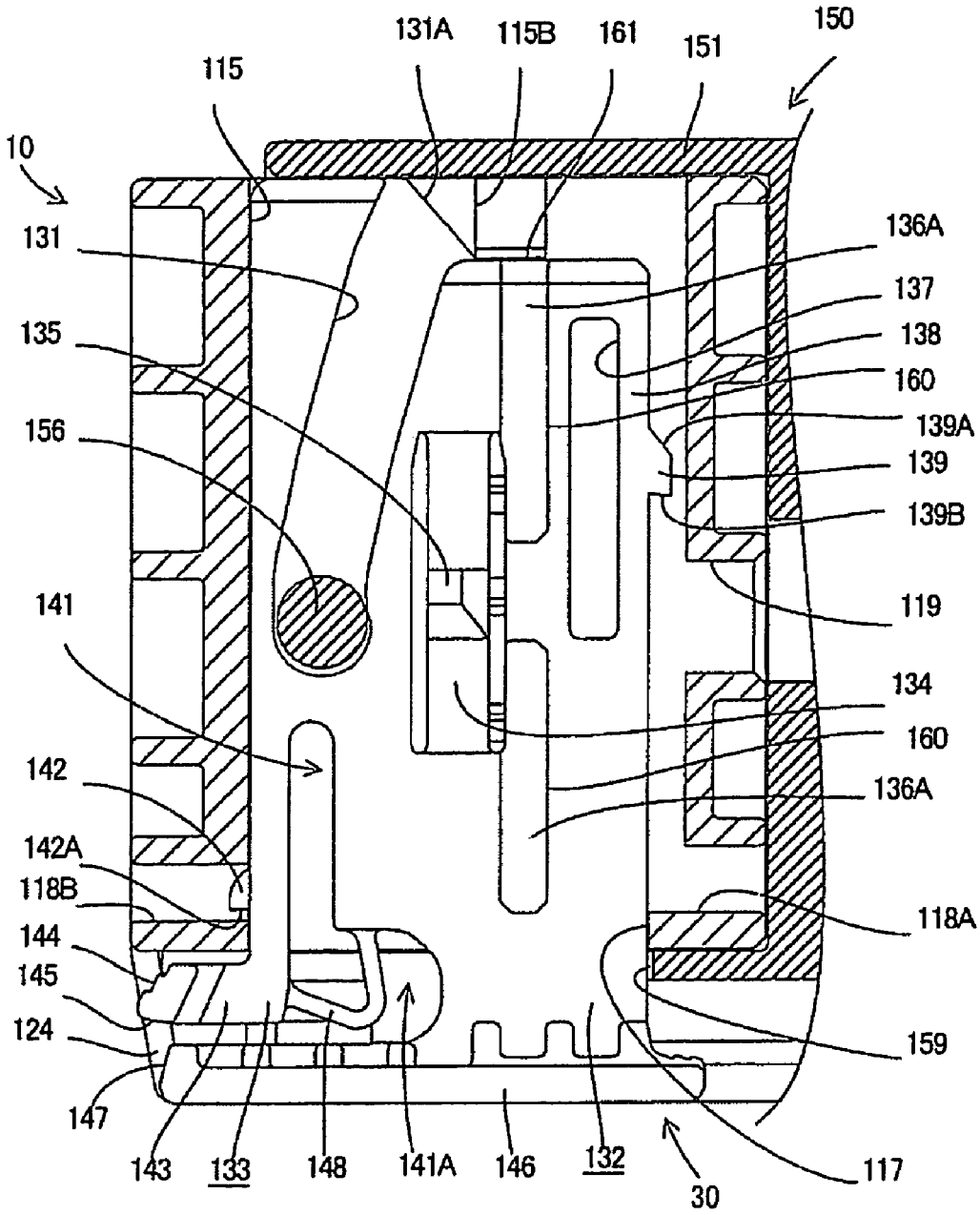
FIG. 32 is a plan view in section showing the slider at the full locking position.

The lock 142 of the lock arm 133 contacts the peripheral edge of the slider entrance/exit 117 when most of the slider 30 is in the slider accommodating portion 115. The slider 30 then is pushed further. As a result, the lock arm 133 deforms resiliently towards the deformation space 141 and the lock 142 moves over the above peripheral edge. The lock arm 133 is restored resiliently when the lock 142 moves over the peripheral edge so that the lock 142 fits into the rear lock 118B, as shown in FIG. 32. The locking surface 142A of the lock 142 opposes the corresponding left surface of the rear lock 118B to lock the slider 30 and the female housing 10 in their connected state. At this time, the slider 30 is at the full locking position 2P where the right edge of the slider 30 contacts the receptacle 151 of the male housing 150 covering the opening at the right end of the slider accommodating portion 115, and the two housings 10, 150 are completely connected to electrically connect the female terminal fittings 112 and the male terminal fittings 152. Further, the locking surfaces 160 of the upper-stage and lower-stage retainers 136A and 136B engage the engaging portions 125A of all of the female terminal fittings 112 to doubly lock the female terminal fittings 112. At this time, the two female terminal fittings 112 in the two right cavities 11 of the lower stage are locked simultaneously by the locking surfaces 160 of the lower-stage retainer 136B at the right side. The housings 10, 150 are connected completely and locked when the slider 30 reaches the full locking position 2P.

The protecting portions 124 on the female housing 10 protect the hand-push portion 143 of the lock arm 133 from above and below by the when the housings 10, 150 are connected completely, as shown in FIG. 15. Additionally, an engaged part of the cam groove 131 and the cam pin 156 is covered by the receptacle 151.

Figure 33:
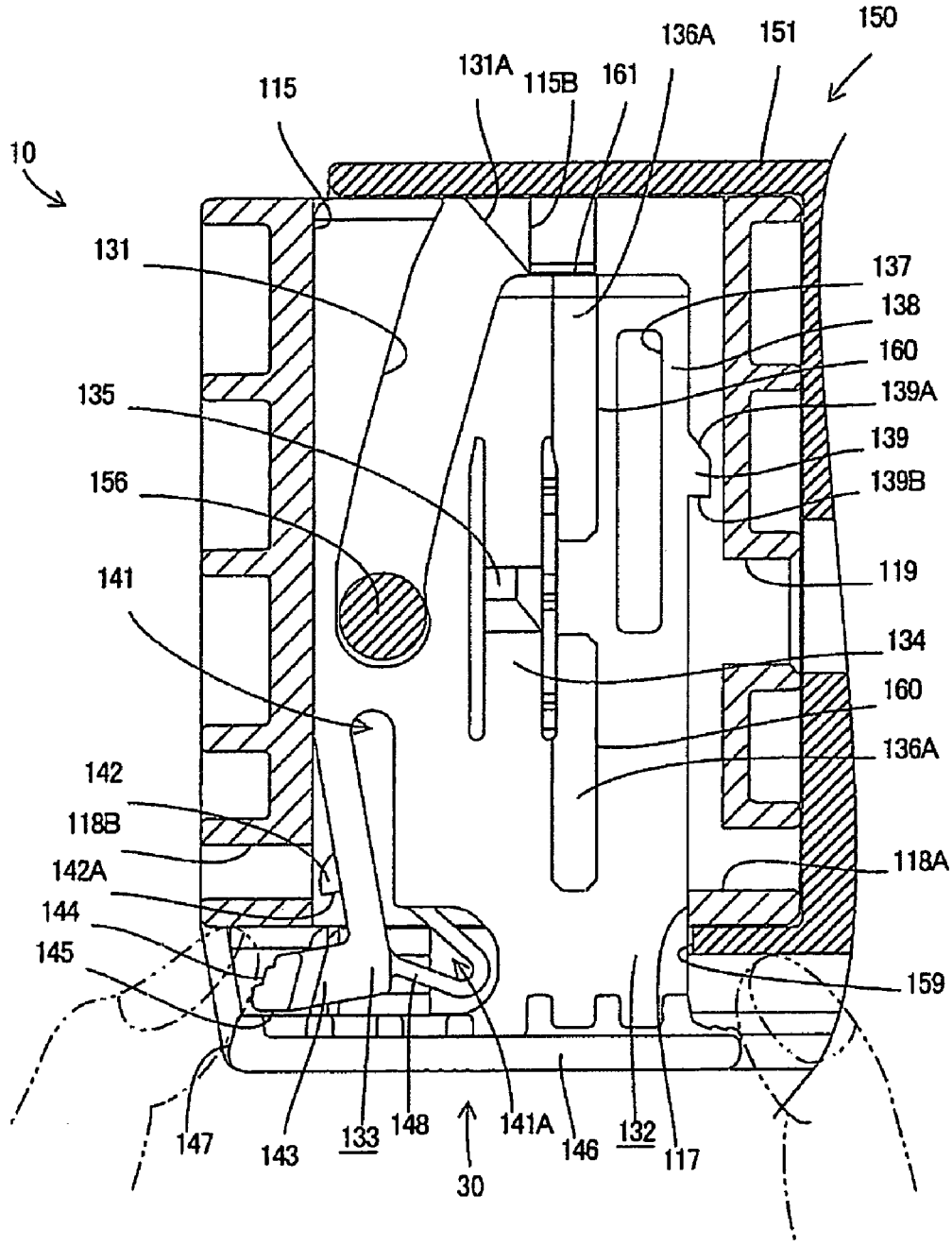
FIG. 33 is a plan view in section showing the slider withdrawn.

To separate the two housings 10, 150, the cover 146 of the slider 30 is held between two fingers from front and back, as shown in FIG. 33. The tip of one finger then is placed on the finger placing surface 144 at the leading end of the hand-push portion 143 and pushes the finger-placing surface 144 towards the main body 132 to unlock the lock arm 133. The cover 146 held between the fingers then is pulled to withdraw the slider 30. The hand-push portion 143 is near the cover 146 and the leading end of the hand-push portion 143 projects out from the peripheral edge of the cover 146. Thus, the finger that pushed the hand-push portion 143 is supported on the finger-supporting surface 147 on the periphery of the cover 146. In this way, the finger that pushed the hand-push portion 143 is supported on a fixed member. The cover 146 and the slider 30 can be unlocked by hooking the finger on the cover 146, which is the fixed member. Therefore, the slider 30 can be withdrawn more easily as compared to an unstable state where the finger is only placed on the resiliently deformable lock arm 133.

When the hand-push portion 143 is pushed to unlock the slider 30, the finger-placing surface 144 of the hand-push portion 143 and the finger-supporting surface 147 of the cover 146 constitute a substantially continuous downward gradient towards the front with respect to the operating direction OD of the slider 130 to extend along the finger obliquely placed from the peripheral edge of the cover 146 to the leading end of the hand-push portion 143. Thus, the finger can fit nicely. In addition, the finger-placing surface 144 of the hand-push portion 143 is stepped. Thus, the finger is unlikely to slip due to a larger frictional force acting on the finger as compared to a case where this surface is a flat surface. Therefore, the slider 30 can be withdrawn easily.

In this way, the unlocked slider 30 can be withdrawn from the slider accommodating portion 115. As the slider 30 is withdrawn, the female housing 10 and the male housing 150 are gradually separated by the cam action of the engagement of the cam groove 131 and the cam pin 156.

As described above, according to this embodiment, the slider 30 is a means for connecting the two housings 10, 150 and also is a means for doubly locking the female terminal fittings 112. Thus, it is not necessary to provide a separate retainer and the female terminal fittings 112 can be retained without increasing the number of parts. Further, the upper-stage and lower-stage retainers 136A and 136B on the upper and lower surfaces of the single main body 132 are engaged with the female terminal fittings 112 in the respective upper and lower cavities 11 to fully lock them, and it is not necessary to provided separate main bodies for the upper and lower cavities 11.

The lower-stage retainer 136B at the right side of the projection 35 extends continuously over two or more juxtaposed cavities 11. Hence, strength can be increased as compared to a case where retainers are provided in an interrupting manner for the respective two juxtaposed cavities 11.

The insufficient insertion detecting surface 161 contacts any insufficiently inserted female terminal fitting 112 to prevent any further insertion of the slider 30. As a result, the insufficiently inserted state of the female terminal fitting 112 can be known.

The slider 30 can be held in the female housing 10 at a standby position 1P where the upper-stage and lower-stage retainers 136A and 136B are at retracted positions to permit the insertion and withdrawal of the female terminal fittings 112 into and from the cavities 11. Thus, the female terminal fittings 112 may be inserted with the slider 30 at the standby position 1P.

The invention is not limited to the above described and illustrated embodiment. For example, the following modified embodiments are also embraced by the technical scope of the present invention as defined by the claims. Beside the following embodiments, various changes can be made without departing from the scope and spirit of the present invention as defined by the claims.

The slider 30 is a substantially rectangular single plate longer in transverse direction in the foregoing embodiment. However, the invention is widely applicable to various other sliders. For example, application to sliders gate-shaped as a whole is also possible.

Although the left and right upper-stage and lower-stage retainers 136A and 136B are provided separately in the foregoing embodiment, the invention is not limited thereto and the left and right retainers may be continuous with each other.

The insufficient insertion detecting surfaces 161 are formed on the upper-stage and lower-stage retainers 130A and 136B in the foregoing embodiment. However these insufficient insertion detecting surfaces 161 may be slanted and the slanted surfaces may contact the terminal connecting portions as the slider is pushed, thereby pushing the female terminal fittings to the proper insertion positions for the correction of the positions.

The front ends of the upper-stage and lower-stage retainers 136A and 136B substantially align with respect to vertical and/or transverse directions in the foregoing embodiment. However, they may be displaced in forward and backward directions in conformity with the sizes of the terminal fittings, for example, if terminal fittings having different sizes are inserted into cavities.

Although the slider 30 is pulled back to the partial locking position at the time of transporting the female housing 10 in the foregoing embodiment, the present invention is not limited thereto and the slider 30 may be pushed to the full locking position and the female housing 10 may be transported with all the female terminal fittings 112 fully locked. Of course, in such a case, the slider 30 needs to be returned to the partial locking position again upon connecting the female housing 10 with the male housing 150.

Although in the foregoing embodiment, the invention has been described with reference to a slider as the movable member, it should be understood that the invention is also applicable to other movable members such as those having an operation path different from a substantially linear path (e.g. a slightly bent path, an elliptic or circular path, etc., such as a rotatable or pivotable lever.

Although the terminal fittings are arranged at upper and lower stages in the foregoing embodiment, they may be arranged at one stage or at three or more stages.

What is claimed is:

1. A connector assembly, comprising:

a first housing with a first cam;

a second housing that is connectable with the first housing along a connecting direction, the second housing having cavities, terminal fittings being insertable and withdrawable into the cavities substantially along the connecting direction of the two housings, each of said cavities having a lock for primarily locking the respective terminal fitting; and a movable member slidably assembled into the second housing in a direction intersecting the connecting direction of the two housings, the movable member being formed with a second cam, the first and second cams cooperating for connecting the two housings by operating the movable member in the second housing, the movable member including at least one retaining portion for secondarily locking the terminal fittings in the cavities to retain the terminal fittings as the movable member is operated in the second housing.

2. The connector of claim 1, wherein an insufficient insertion detecting surface is formed on the movable member for contacting any insufficiently inserted terminal fittings as the movable member is operated and thereby preventing movement of the movable member.

3. The connector assembly of claim 1, wherein the second housing has a movable member accommodating space intersecting the cavities and configured for receiving the movable member, at least one communicating portion providing communication between the movable member accommodating space and the cavities, the retaining portion moving along the communicating portion as the movable member is operated in the movable member accommodating space, and being on insertion and withdrawal paths for the terminal fittings in the respective cavities to secondarily lock the terminal fittings when the movable member is inserted completely.

4. The connector of claim 3, wherein a plurality of the cavities are juxtaposed along a moving direction of the movable member), and the retaining portion having an elongated shape substantially continuous along the moving direction of the movable member for extending over at least two of the juxtaposed cavities.

5. The connector of claim 3, wherein the cavities are arranged in first and second stages, the at least one communication portion comprising first and second communication portions communicating respectively with the cavities in the first and second stages, the movable member having a plate-shaped main body with opposite first and second surfaces, the at least one retaining portion comprising first and second retaining portions disposed respectively on the first and second surfaces of the main body and moving along the first and second communicating portions as the movable member is operated in the movable member accommodating space.

6. A connector, comprising:

a housing into which terminal fittings are to be inserted, the housing being connectable with a mating housing of a mating connector along a connecting direction, and a movable member having at least one cam and being assembled with the housing in a direction at an angle to the connecting direction, the movable member being operable to develop a cam action for connecting the housing with the mating housing, wherein the movable member being formed with at least one surface aligned for moving at least one insufficiently inserted terminal fitting towards a substantially proper insertion position by engaging the insufficiently inserted terminal fitting as the movable member is assembled with the housing and operated to connect the housing with the mating housing.

7. The connector of claim 6, wherein the housing is connectable with the mating housing substantially in parallel with an inserting direction of the terminal fittings into the housing.

8. The connector of claim 6, wherein the movable member is a single plate.

9. The connector of claim 6, wherein the terminal fittings are arranged at least at first and second stages in the housing, and the movable member is accommodated between the terminal fittings at the first stage and the terminal fittings at the second stage.

* * * * *